US012735884B2

(12) United States Patent
Minami et al.

(10) Patent No.: US 12,735,884 B2
(45) Date of Patent: Sep. 15, 2026

(54) FLUSH TOILET

(71) Applicant: TOTO LTD., Kitakyushu (JP)

(72) Inventors: Takehiro Minami, Fukuoka (JP); Hiroshi Hashimoto, Fukuoka (JP); Isami Sakaba, Fukuoka (JP); Kazunari Yasui, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 209 days.

(21) Appl. No.: 18/226,275

(22) Filed: Jul. 26, 2023

(65) Prior Publication Data

US 2024/0035267 A1 Feb. 1, 2024

(30) Foreign Application Priority Data

Jul. 29, 2022 (JP) ..... 2022-121161
Jul. 29, 2022 (JP) ..... 2022-121219
Jul. 29, 2022 (JP) ..... 2022-121220

(51) Int. Cl.
*E03D 11/08* (2006.01)

(52) U.S. Cl.
CPC ..... *E03D 11/08* (2013.01)

(58) Field of Classification Search
CPC ..... E03D 11/08
See application file for complete search history.

(56) References Cited

U.S. PATENT DOCUMENTS

2007/0061955 A1 3/2007 Asada et al.
2008/0276361 A1* 11/2008 Mueller ..... E03D 11/08 4/420
2010/0146693 A1* 6/2010 Yamaguchi ..... E03D 5/10 4/420
2010/0251471 A1 10/2010 Cadavid et al.
(Continued)

FOREIGN PATENT DOCUMENTS

CN 102363972 2/2012
CN 107542140 1/2018
(Continued)

OTHER PUBLICATIONS

Japanese Notice of submission publication or the like for Japanese Patent Application No. 2022-121161 dated Sep. 10, 2024.
(Continued)

*Primary Examiner* — Lauren A Crane
(74) *Attorney, Agent, or Firm* — Amin, Turocy & Watson, LLP

(57) ABSTRACT

A flush toilet includes a bowl portion configured to receive waste, a trap portion extending from the bowl portion and configured to discharge the waste received in the bowl portion, a main conduit through which washing water toward the bowl portion flows, a rim communication hole into which the washing water flows from the main conduit, a rim conduit through which the washing water that has flowed in from the rim communication hole flows, and a rim spout configured to supply the washing water flowing through the rim conduit to the bowl portion, wherein the rim
(Continued)

spout has a low-flow rate spout that becomes the rim spout when the washing water flowing through the rim conduit is of a low flow rate and a high-flow rate spout that becomes the rim spout when the washing water flowing through the rim conduit is of a high flow rate.

17 Claims, 16 Drawing Sheets

(56) References Cited

U.S. PATENT DOCUMENTS

| | | | | |
|---|---|---|---|---|
| 2015/0107011 | A1* | 4/2015 | Bucher | E03D 11/14 4/420 |
| 2017/0370080 | A1 | 12/2017 | Kashirajima et al. | |
| 2017/0370081 | A1* | 12/2017 | Kashirajima | E03D 11/18 |
| 2021/0270028 | A1 | 9/2021 | Chen et al. | |

FOREIGN PATENT DOCUMENTS

| | | |
|---|---|---|
| CN | 209129102 | 7/2019 |
| CN | 213233700 | 5/2021 |
| JP | 51-83145 | 7/1976 |
| JP | 51-083151 | 7/1976 |
| JP | 02-116580 | 9/1990 |
| JP | 4-83032 | 3/1992 |
| JP | 7-324368 | 12/1995 |
| JP | 2002-294837 | 10/2002 |
| JP | 2004-116279 | 4/2004 |
| JP | 2010-7257 | 1/2010 |
| JP | 2013-238048 | 11/2013 |
| JP | 2018-003250 | 1/2018 |
| JP | 2018-003262 | 1/2018 |
| JP | 2018-112069 | 7/2018 |
| JP | 2019-027214 | 2/2019 |
| JP | 2020-026699 | 2/2020 |
| JP | 2020-159188 | 10/2020 |
| JP | 2021-8790 | 1/2021 |
| JP | 2021-105335 | 7/2021 |
| JP | 2021-134602 | 9/2021 |
| JP | 2021-134642 | 9/2021 |
| JP | 2002-322717 | 11/2022 |
| KR | 10-2011-0107699 | 10/2011 |
| KR | 10-2011-0123472 | 11/2011 |
| WO | 2005/085538 | 9/2005 |
| WO | 2015/061615 | 4/2015 |

OTHER PUBLICATIONS

"Flow Rate Knowledge.COM, Pressure Loss and its Reason", URL:https://web.archive.org/web/202008 04081147/ https://www.keyence.co.jp/ss/products/process/flowmeter/technique/pressureioss.jsp.

"Flow Rate Knowledge.COM, What is Flow Velocity?", URL: https://web.archive.org/web/20200923070047/https://www.keyence.eo.jp/ss/products/process/flowmeter/base/flow-velocity.jps.

* cited by examiner

FLUSH TOILET

CROSS-REFERENCE TO RELATED APPLICATION(S)

This application is based upon and claims the benefit of priority to Japanese Patent Application No. 2022-121161 filed on Jul. 29, 2022, the entire contents of which are herein incorporated by reference, Japanese Patent Application No. 2022-121219 filed on Jul. 29, 2022, the entire contents of which are herein incorporated by reference, and Japanese Patent Application No. 2022-121220 filed on Jul. 29, 2022, the entire contents of which are herein incorporated by reference.

FIELD

Embodiments of the disclosure relate to flush toilets.

BACKGROUND

Conventionally, there has been known a technique in which, in a flush toilet, the bowl surface of a bowl portion that receives waste is washed by a flow, which swirls (swirling flow), of washing water supplied from a water spout to the bowl surface.

Such flush toilets include those that are equipped with a water storage tank, and a reduced diameter portion is formed in a water conduit through which the washing water flows toward the bowl surface such that the water-conducting cross-sectional area of the water conduit is smaller as the water supply flow rate from the water storage tank is larger so that, even when the water supply flow rate is larger or smaller than that needed by the toilet bowl body, changes in the distribution ratio and the flow velocity of the washing water supplied from the water spout can be suppressed and the washing water of an appropriate water supply flow rate can be supplied to the bowl portion (see, for example, Japanese Patent Application Publication No. 2020-159188).

Incidentally, in what is called flush valve toilets, which supply primary water pressure to the toilet bowl body, as the water pressure varies in the region where the toilet bowl is installed, the washing water flowing through the conduit may have a low flow rate or a high flow rate and the primary water pressure may vary from region to region.

Meanwhile, the above-described conventional flush toilets need the water storage tank, so it is difficult to accommodate fluctuations in the flow rate of the washing water in flush valve toilets and others that supply primary water pressure to the toilet bowl body.

For example, when the washing water spout is defined as an opening that defines the flow velocity of the washing water supplied to the bowl surface of the bowl portion, it is conceivable that the spout may be switched between cases where the washing water flowing through the conduit is of a low flow rate and a high flow rate. Even for this, in the above-described conventional flush toilets, while the cross-sectional area of the washing water flowing through the conduit becomes smaller once at the reduced diameter portion, it becomes larger again at the time of being supplied from the water spout, so the water spout is not switched between the cases of a low flow rate and a high flow rate.

Conventionally, there have been known flush toilets that jet washing water from a rim spout and a jet spout to discharge waste (see, for example, Japanese Patent Application Laid-open No. 2018-3250).

The above-described flush toilet suppresses the generation of abnormal noise when jetted from the jet spout. However, there is room for further improvement in the above-described flush toilet with regard to the generation of abnormal noise.

Conventionally, there have been known wall-hung type flush toilets that are mounted on the wall surface (see, for example, Japanese Patent Application Publication No. 2013-238048).

Wall-hung type flush toilets need to have load-bearing performance at the mounting portion which is mounted on the wall surface. In the above-described flush toilets, there is room for improvement in terms of weight reduction.

SUMMARY

A flush toilet according to an aspect of an embodiment includes a bowl portion configured to receive waste, a trap portion extending from the bowl portion and configured to discharge the waste received in the bowl portion, a main conduit through which washing water toward the bowl portion flows, a rim communication hole into which the washing water flows from the main conduit, a rim conduit through which the washing water that has flowed in from the rim communication hole flows, and a rim spout configured to supply the washing water flowing through the rim conduit to the bowl portion, wherein the rim spout has a low-flow rate spout that becomes the rim spout when the washing water flowing through the rim conduit is of a low flow rate and a high-flow rate spout that becomes the rim spout when the washing water flowing through the rim conduit is of a high flow rate.

BRIEF DESCRIPTION OF DRAWING(S)

DESCRIPTION OF EMBODIMENT(S)

With reference to the accompanying drawings, the following describes in detail embodiments of the flush toilet disclosed in the present application. The invention, however, is not limited by the following embodiments. Note that the drawings are schematic and the relation between the dimensions of each element and the ratio of each element may differ from reality. The drawings may also contain parts that differ from each other in dimensional relations and proportions.

1. First Embodiment

Figure 1:
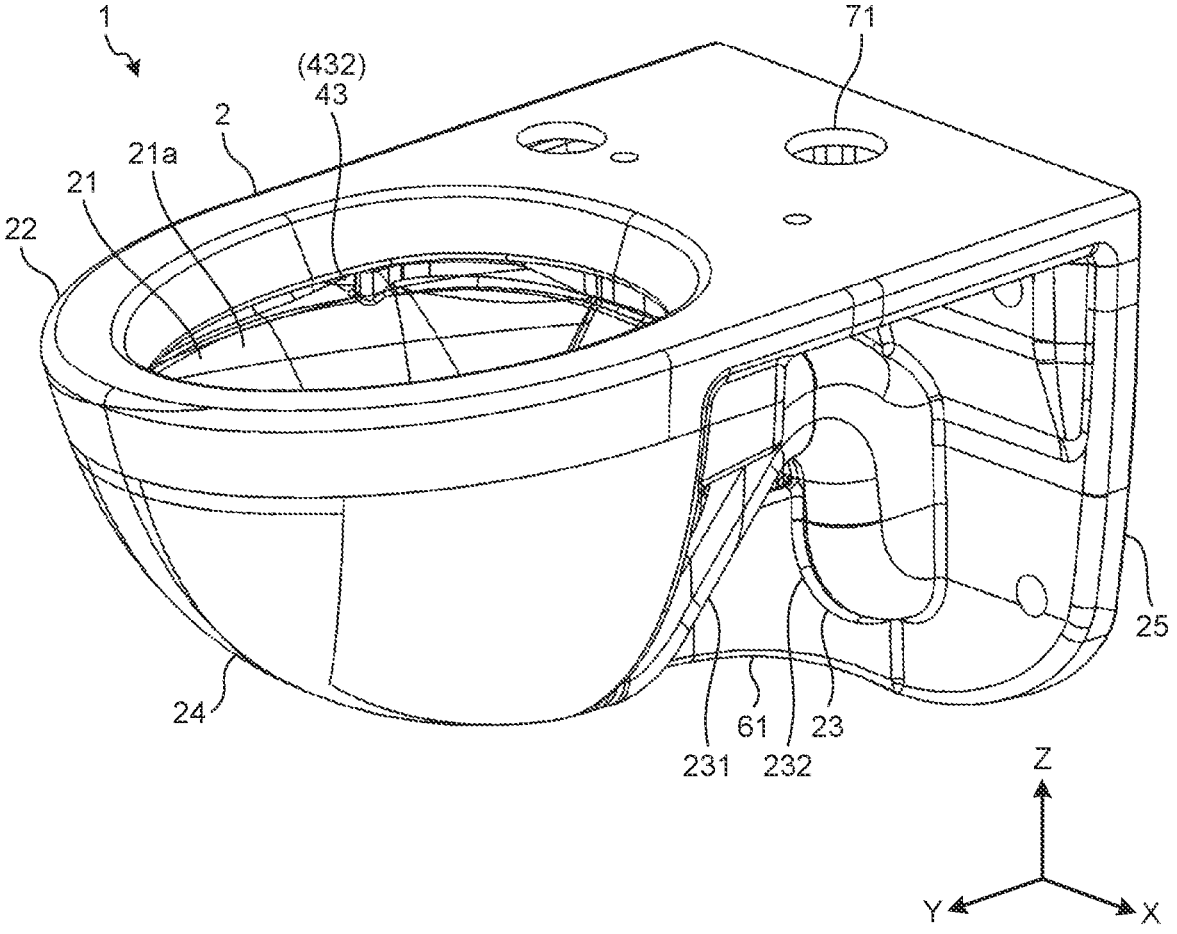
FIG. 1 is a schematic perspective view illustrating a flush toilet according to a first embodiment.
Figure 2:
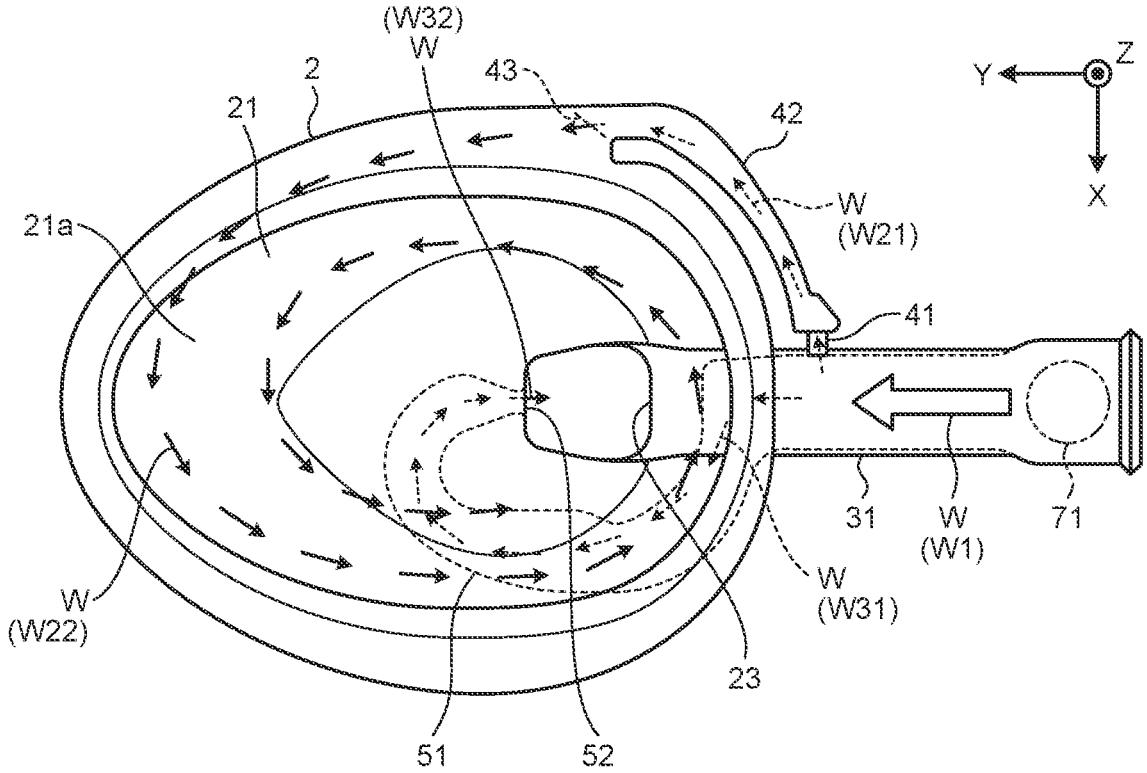
FIG. 2 is a schematic plan view illustrating a rim conduit and a jet conduit.

Overall Configuration of Flush Toilet Referring to FIGS. 1 and 2, an example of the overall configuration of a flush toilet 1 according to a first embodiment is described. FIG. 1 is a schematic perspective view illustrating the flush toilet 1 in the first embodiment. FIG. 2 is a schematic plan view illustrating a rim conduit 42 and a jet conduit 51.

The drawings, including FIG. 1, may indicate a three-dimensional Cartesian coordinate system including the Z-axis with the vertical upward (upward) direction as the positive direction. In the following description, for convenience of explanation, it may be defined that the X-axis positive direction is leftward, the X-axis negative direction is rightward, the Y-axis positive direction is forward, and the Y-axis negative direction is backward, and the X-axis direction may be referred to as left-and-right direction, the Y-axis direction as front-and-back direction, and the Z-axis direction as up-and-down direction.

As illustrated in FIG. 1, the flush toilet 1 is what is called a wall-hung type that is mounted on the wall surface of a toilet room. The flush toilet 1 may be what is called a floor-mounted type that is installed on the floor of the toilet room.

The flush toilet 1 is what is called a blowout type, in which washing water of powerful water force is jetted from a later-described jet spout 52 (see FIG. 2) toward a later-described trap portion 23 to generate a powerful water flow, thereby blowing away the waste toward the downstream side. The flush toilet 1 may be of a system other than this, such as a wash-off (wash-down) system, or a siphon system.

The flush toilet 1 is what is called a flush valve type that supplies the washing water to a later-described toilet bowl body 2 by primary water pressure from a water supply source such as a tap.

The flush toilet 1 is made of ceramic. The flush toilet 1, however, is not limited to ceramic and may be made of resin or of a combination of ceramic and resin.

As illustrated in FIGS. 1 and 2, the flush toilet 1 is equipped with the toilet bowl body 2. The toilet bowl body 2 is provided with a bowl portion 21, a rim portion 22, a trap portion 23, a skirt portion 24, and a back surface 25. The toilet bowl body 2 is also provided with a main conduit 31, a rim communication hole 41 (see FIG. 3), the rim conduit 42, a rim spout 43, the jet conduit 51, and a jet spout 52.

The bowl portion 21 is formed so that an inner surface (bowl surface) 21*a* that receives waste is in a bowl shape. In the bottom of the bowl portion 21, a predetermined amount of pooled water is reserved. In the bottom of the bowl portion 21, the trap portion 23 is connected.

The rim portion 22 is provided at the upper edge portion of the bowl portion 21. The rim portion 22 is formed annularly along the upper edge portion of the bowl portion 21.

The trap portion 23 extends rearward from the bottom of the bowl portion 21 and discharges the waste received in the bowl portion 21 to an external pipe (not depicted) through which it is discharged. The trap portion 23 includes an ascending pipe 231 and a descending pipe 232, for example. The upstream end of the ascending pipe 231 is connected to the bottom of the bowl portion 21. The ascending pipe 231 is a conduit line extending upward toward the rear from the bottom of the bowl portion 21, that is, being inclined to rise. The upstream end of the descending pipe 232 is connected to the downstream end of the ascending pipe 231. The descending pipe 232 is a conduit line extending downward from the ascending pipe 231. The downstream end of the descending pipe 232 is connected to an external pipe (not depicted).

The skirt portion 24 is provided to cover the forward region of the bowl portion 21. The skirt portion 24 forms the external form of the flush toilet 1 in the forward region of the bowl portion 21.

The back surface 25 is provided behind the bowl portion 21. The back surface 25 is secured to the wall surface of the toilet room, for example, by mounting fixtures to the mounting holes. In this manner, as the back surface 25 is fixed to the wall surface, the flush toilet 1 is secured to the wall surface.

As illustrated in FIG. 2, the main conduit 31 extends forward from a supply port 71 of washing water in the flush toilet 1. In the main conduit 31, washing water W (W1) flows toward the bowl portion 21. The main conduit 31 is connected to the rim conduit 42 and the jet conduit 51 which will be described later.

As illustrated in FIG. 2, the rim communication hole 41 is an inlet (hole) through which the washing water W1 flows in from the main conduit 31. Into the rim communication hole 41, the washing water W1 branched from the main conduit 31 flows. The rim conduit 42 is provided on the downstream side of the rim communication hole 41 and is a flow path through which washing water W (W21) has flowed in from the rim communication hole 41 flows. The rim conduit 42 will be described later using FIG. 3 and others.

The rim spout 43 is an outlet of the washing water W21 in the rim conduit 42 and supplies the washing water W21 flowing through the rim conduit 42 to the bowl portion 21. Washing water W22 supplied from the rim spout 43 to the bowl portion 21 becomes a swirling flow that flows into the trap portion 23 while swirling around the bowl surface 21*a*. In the flush toilet 1, the bowl surface 21*a* is washed (tornado washing) by such a swirling flow.

The rim spout 43 includes a low-flow rate spout 431 and a high-flow rate spout 432. The configuration of the rim spout 43 (low-flow rate spout 431 and high-flow rate spout 432) will be described later using FIG. 3 and others.

As illustrated in FIG. 2, the jet conduit 51 is a flow path through which the washing water W1 from the main conduit 31 flows in and washing water W (W31) flows toward the jet spout 52 which will be described later. In the jet conduit 51, on the downstream side of a pressure-rate control portion 45, which will be described later, connecting the main conduit 31 and the rim conduit 42, the washing water W1 from the main conduit 31 flows in.

The jet spout 52 jets washing water W (W32) that has flowed through the jet conduit 51 from the front of the trap portion 23 toward the trap portion 23.

As illustrated in FIG. 1, the flush toilet 1 may be provided with a modesty panel 61 to reinforce the trap portion 23. Such a modesty panel 61 is a plate-like member and is provided below the trap portion 23.

Rim Conduit and Rim Spout

Figure 3:
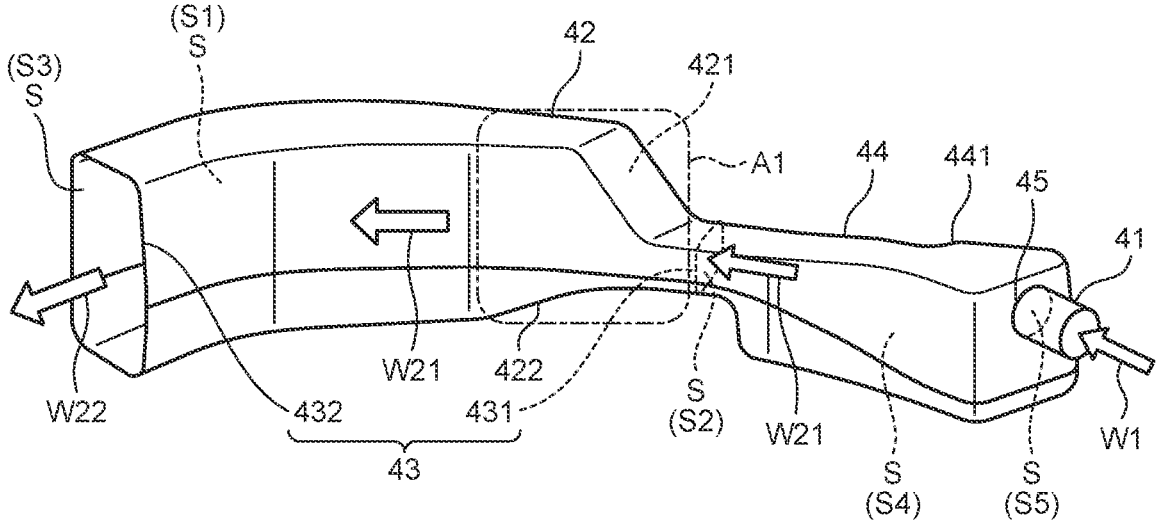
FIG. 3 is a schematic perspective view illustrating the rim conduit and a rim spout.

Next, with reference to FIG. 3, the rim conduit 42 and the rim spout 43 will be described. FIG. 3 is a schematic perspective view illustrating the rim conduit 42 and the rim spout 43.

As illustrated in FIG. 3, in the rim conduit 42, the washing water W21 that has flowed in from the rim communication hole 41 flows.

The rim conduit 42 has an inclined wall portion 421 for which the upper surface is inclined upward toward downstream at least up to the high-flow rate spout 432 including a downstream region A1 immediately adjacent to the low-flow rate spout 431. The rim conduit 42 has an inclined wall portion 422 for which the bottom surface is inclined downward toward downstream at least up to the high-flow rate spout 432 including the downstream region A1 immediately adjacent to the low-flow rate spout 431. Thus, the rim conduit 42 has a portion in which a flow-path cross-sectional area S (S1) expands continuously and gradually from the later-described low-flow rate spout 431 side to the downstream high-flow rate spout 432 side, which becomes the rim spout 43. That is, the rim conduit 42 is a flow path having a portion gently widening from the upstream low-flow rate spout 431 side to the downstream high-flow rate spout 432 side. The flow-path cross-sectional area S is a cross-section cut orthogonally to the flow direction of the washing water W21. The rim conduit 42 only needs to have inclined wall portions 421, 422 at least in the downstream region A1 immediately adjacent to the low-flow rate spout 431, but may have the inclined wall portions 421, 422 all the way from the low-flow rate spout 431 to the high-flow rate spout 432, for example.

The rim spout 43 is an outlet of the washing water W21 in the rim conduit 42 as in the foregoing and supplies the washing water W21 flowing through the rim conduit 42 to the bowl portion 21. The rim spout 43 includes the low-flow rate spout 431 and the high-flow rate spout 432.

The low-flow rate spout 431 is formed in the middle of the flow path of the rim conduit 42, and functions as the rim spout 43 when the washing water W21 flowing through the rim conduit 42 is of a low flow rate. The low-flow rate spout 431 defines the flow velocity of the washing water W21 (W22) when the washing water W21 flowing through the rim conduit 42 is of a low flow rate.

The high-flow rate spout 432 is formed at the downstream-most end of the rim conduit 42, and functions as the rim spout 43 when the washing water W21 flowing through the rim conduit 42 is of a high flow rate. The high-flow rate spout 432 defines the flow velocity of the washing water W21 (W22) when the washing water W21 flowing through the rim conduit 42 is of a high flow rate.

Thus, the low-flow rate spout 431 and the high-flow rate spout 432 are formed in the same flow path referred to as the rim conduit 42, and are arranged so that, in the rim conduit 42, the low-flow rate spout 431 is on the upstream side and the high-flow rate spout 432 is on the downstream side. The flow-path cross-sectional area S (S2) of the low-flow rate spout 431 is smaller than the flow-path cross-sectional area S (S3) of the high-flow rate spout.

The rim conduit 42 has an agitation chamber 44 arranged on the upstream side of the low-flow rate spout 431. The flow-path cross-sectional area S (S4) of the agitation chamber 44 is larger than the flow-path cross-sectional area S2 of the low-flow rate spout 431. The agitation chamber 44 has a wall portion 441 that is substantially orthogonal to the flow direction of the washing water W21 so as to block the flow of the washing water W21. The wall portion 441 is provided on the upstream side of the low-flow rate spout 431 and opposite the rim communication hole 41.

As illustrated in FIG. 3, the flush toilet 1 (see FIG. 1) is equipped with the above-described pressure-rate control portion 45. The pressure-rate control portion 45 is a portion connecting the main conduit 31 and the rim conduit 42 and regulates the flow velocity of the washing water W21 that flows in from the rim communication hole 41 before flowing into the rim conduit 42. Such a pressure-rate control portion 45 connects the main conduit 31 and the rim conduit 42 on the upstream side of the jet conduit 51 (see FIG. 2).

As illustrated in FIG. 3, in the rim conduit 42, the flow-path cross-sectional area S2 of the low-flow rate spout 431 is larger than the flow-path cross-sectional area S (S5) of the pressure-rate control portion 45. The flow-path cross-sectional area S3 of the high-flow rate spout 432 is larger than the flow-path cross-sectional area S2 of the low-flow rate spout 431. The flow-path cross-sectional area S4 of the agitation chamber 44 is larger than the flow-path cross-sectional area S2 of the low-flow rate spout 431.

Flow Mode of Washing Water at Low-flow Rate Spout

Figure 4:
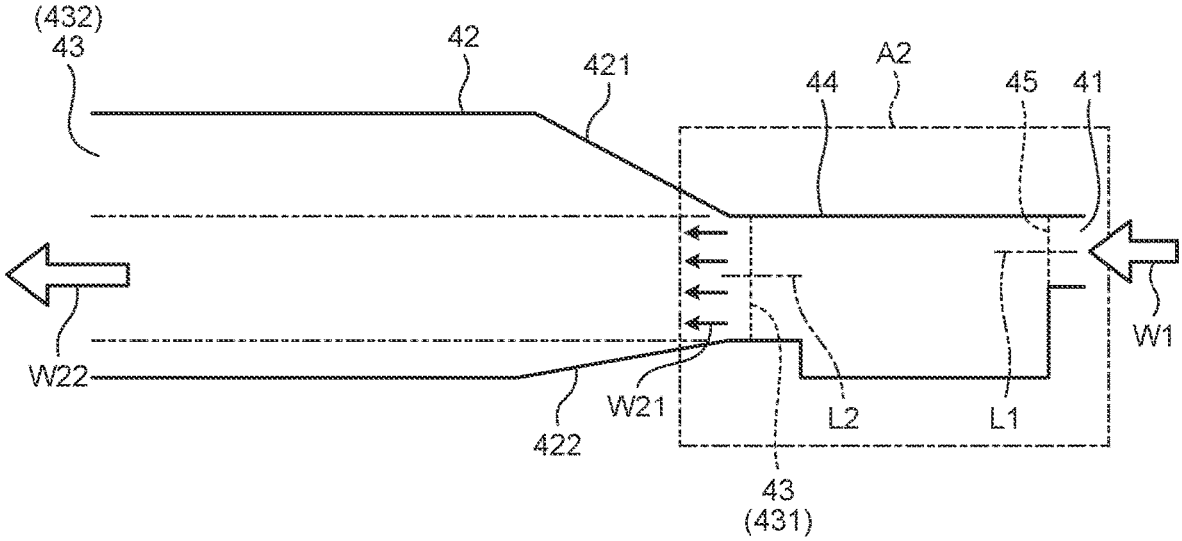
FIG. 4 is an explanatory diagram (Part 1) of washing water from a low-flow rate spout which becomes the rim spout when the washing water flowing through the rim conduit is of a low flow rate.
Figure 5:
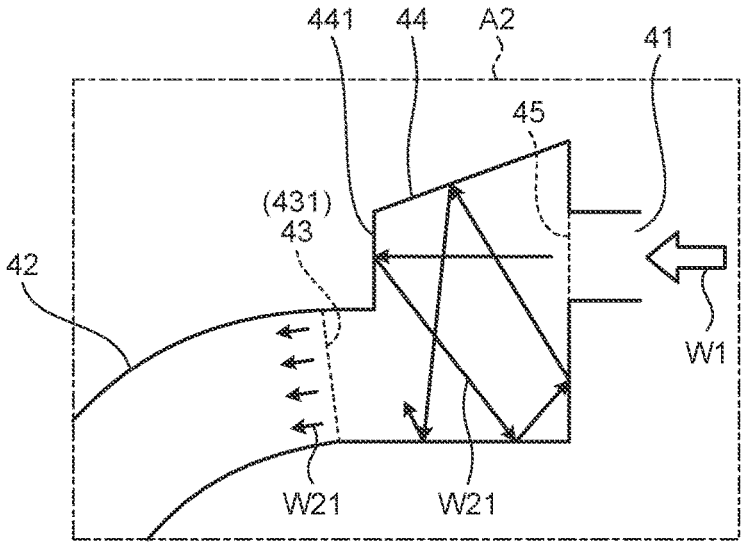
FIG. 5 is an explanatory diagram (Part 2) of the washing water from the low-flow rate spout which becomes the rim spout when the washing water flowing through the rim conduit is of a low flow rate.

Next, with reference to FIGS. 4 and 5, the flow mode of the washing water W21 at the low-flow rate spout 431 will be explained. FIGS. 4 and 5 are explanatory diagrams for the washing water W21 at the low-flow rate spout 431 that becomes the rim spout 43 when the washing water W21 flowing through the rim conduit 42 is of a low flow rate. FIG. 4 schematically illustrates the rim conduit 42 viewed from the horizontal direction. FIG. 5 schematically illustrates a predetermined region A2, which is on the upstream side in the rim conduit 42, viewed from the vertical direction (above).

As illustrated in FIG. 4, when the washing water W21 flowing through the rim conduit 42 is at a low flow rate, the flow velocity of the washing water W21 supplied from the rim conduit 42 to the bowl portion 21 (see FIG. 2) is regulated by the low-flow rate spout 431 of the small flow-path cross-sectional area S2.

The washing water W21 for which the flow velocity has been regulated at the low-flow rate spout 431 is attracted to the inner surface of the rim conduit 42 by the Coanda effect because the flow path of the rim conduit 42 is gently expanded toward the high-flow rate spout 432 on the downstream side, and flows along the flow path shape. Therefore, the lowering in the flow velocity of the washing water W22 supplied from the rim spout 43 (low-flow rate spout 431) to the bowl portion 21 can be suppressed.

As illustrated in FIG. 4, the central axis L (L1) in the flow direction of the washing water W21 in the pressure-rate control portion 45 is located above the central axis L (L2) in the flow direction of the washing water W21 in the low-flow rate spout 431, so the washing water W21 accelerated in the pressure-rate control portion 45 does not flow directly into the low-flow rate spout 431. The washing water W21 that has been accelerated in the pressure-rate control portion 45 flows into the low-flow rate spout 431 after the flow is in a turbulent and swirling state in the upstream agitation chamber 44. This makes it easier for the low-flow rate spout 431 to be watertight.

Because the low-flow rate spout 431 is arranged above the agitation chamber 44, the washing water W21 that has been accelerated in the pressure-rate control portion 45 does not flow directly into the low-flow rate spout 431, but flows into the low-flow rate spout 431 after the flow is in a turbulent and swirling state in the upstream agitation chamber 44. This makes it easier for the low-flow rate spout 431 to be watertight.

As illustrated in FIG. 5, because the washing water W21 that has been accelerated in the pressure-rate control portion 45 flows into the low-flow rate spout 431 after colliding against the wall portion 441 due to the wall portion 441 arranged on the upstream side of the low-flow rate spout 431, the flow is in a turbulent and swirling state in the agitation chamber 44, making it easier for the low-flow rate spout 431 to be watertight.

Figure 6:
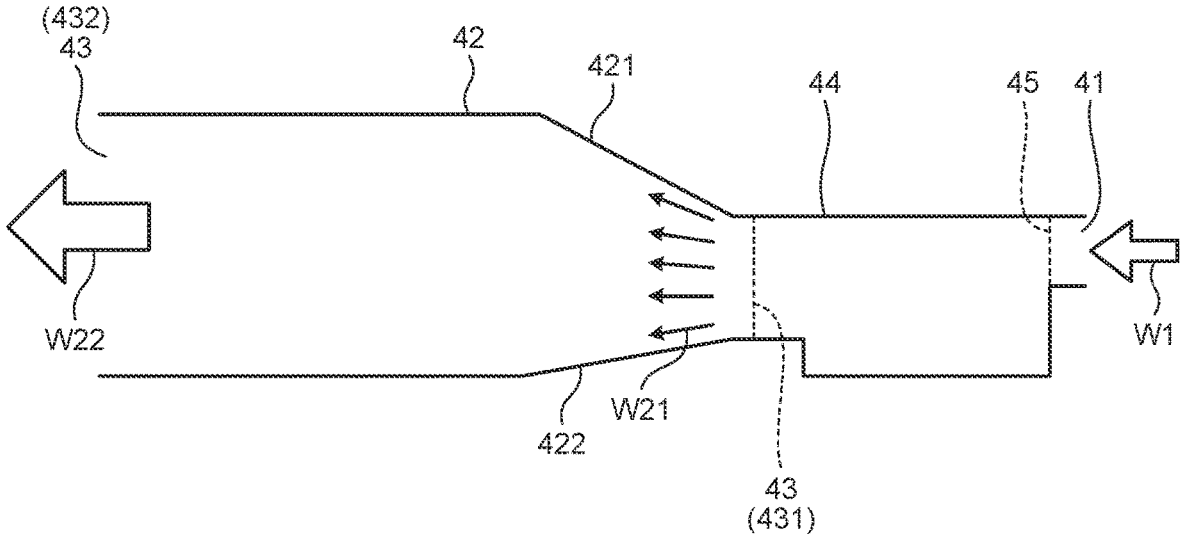
FIG. 6 is an explanatory diagram of the washing water from a high-flow rate spout which becomes the rim spout when the washing water flowing through the rim conduit is of a high flow rate.

Flow Mode of Washing Water at High-flow Rate Spout Next, with reference to FIG. 6, the flow mode of the washing water W21 at the high-flow rate spout 432 will be explained. FIG. 6 is an explanatory diagram of the washing water W21 (W22) at the high-flow rate spout 432 that becomes the rim spout 43 when the washing water W21 flowing through the rim conduit 42 is of a high flow rate. FIG. 6 schematically illustrates the rim conduit 42 viewed from the horizontal direction.

As illustrated in FIG. 6, when the washing water W21 flowing through the rim conduit 42 is at a high flow rate, the flow velocity of the washing water W22 supplied from the rim conduit 42 to the bowl portion 21 (see FIG. 2) is regulated by the high-flow rate spout 432 of the large flow-path cross-sectional area S3.

The washing water W22 from the high-flow rate spout 432 is supplied to the bowl portion 21 while remaining in a restrained flow velocity state in the rim conduit 42 for which the flow path is gently expanding toward the high-flow rate spout 432. Thus, the washing water W22 for which the flow velocity is regulated by the high-flow rate spout 432 does not increase the flow velocity excessively.

According to the flush toilet in the above-described embodiment, when the washing water W21 flowing through the rim conduit 42 is of a low flow rate, it is switched to the low-flow rate spout 431 as the rim spout 43. This makes it possible to suppress the lowering in the flow force (flow velocity) of the washing water W22 supplied from the rim spout 43 (low-flow rate spout 431) when the washing water W21 flowing through the rim conduit 42 is of a low flow rate, thereby suppressing the deterioration in washing performance of the bowl portion 21. Meanwhile, when the washing water W21 flowing through the rim conduit 42 is of a high flow rate, it is switched to the high-flow rate spout 432 as the rim spout 43. This makes it possible to suppress the flow force (flow velocity) of the washing water W22 supplied from the rim spout 43 (high-flow rate spout 432) from increasing excessively when the washing water W21 flowing through the rim conduit 42 is of a high flow rate, thereby preventing the washing water W from jumping out from the bowl portion 21. Thus, it is possible to suppress the deterioration in the washing performance and prevent the washing water W from jumping out regardless of the flow rate fluctuation of the washing water W, that is, it is possible to respond to the flow rate fluctuation of the washing water W, so that the basic performance of the toilet bowl over a wide range of water supply flow rates can be ensured.

The low-flow rate spout 431 and the high-flow rate spout 432 are formed in the same flow path and, in addition, the flow-path cross-sectional area S2 of the low-flow rate spout 431 is smaller than the flow-path cross-sectional area S3 of the high-flow rate spout 432, so that the flow velocity of the washing water W21 supplied to the bowl portion 21 is regulated by the low-flow rate spout 431 having the small flow-path cross-sectional area S2 when the washing water W21 flowing through the rim conduit 42 is of a low flow rate. This makes it possible to suppress the lowering in the flow velocity of the washing water W22 supplied from the rim spout 43 (low-flow rate spout 431) when the washing water W21 flowing through the rim conduit 42 is of a low flow rate, thereby suppressing the deterioration in the washing performance of the bowl portion 21. Meanwhile, when the washing water W21 flowing through the rim conduit 42 is of a high flow rate, the flow velocity of the washing water W21 supplied to the bowl portion 21 is regulated by the high-flow rate spout 432 having the large flow-path cross-sectional area S3. This makes it possible to suppress the flow velocity of the washing water W22 supplied from the rim spout 43 (high-flow rate spout 432) from increasing excessively when the washing water W21 flowing through the rim conduit 42 is of a high flow rate, thereby preventing the washing water W from jumping out from the bowl portion 21.

The low-flow rate spout 431 is arranged on the upstream side of the high-flow rate spout 432, which makes it possible to form the low-flow rate spout 431 and the high-flow rate spout 432 in the same flow path. Then, when the washing water W21 flowing through the rim conduit 42 is of a low flow rate, the washing water W22 is supplied from the low-flow rate spout 431 to the bowl portion 21 and the lowering in the flow velocity of the washing water W21 supplied from the rim spout 43 (low-flow rate spout 431) can be suppressed, thereby suppressing the deterioration in the washing performance of the bowl portion 21. Meanwhile, when the washing water W21 flowing through the rim conduit 42 is of a high flow rate, the flow velocity of the washing water W22 supplied from the rim spout 43 (high-flow rate spout 432) can be suppressed from increasing excessively, thereby preventing the washing water W from jumping out from the bowl portion 21.

Furthermore, between the low-flow rate spout 431 and the high-flow rate spout 432 including at least the downstream region A1 immediately adjacent to the low-flow rate spout 431, as the flow-path cross-sectional area S1 in the rim conduit 42 is continuously and gradually expanded from the low-flow rate spout 431 side toward the high-flow rate spout 432 side, that is, the flow path is gently expanded from the upstream low-flow rate spout 431 side to the downstream high-flow rate spout 432 side, the washing water W21 flowing through the rim conduit 42 from the low-flow rate spout 431 to the high-flow rate spout 432 is attracted to the inner surface of the rim conduit 42 (Coanda effect) and the washing water W21 flows along the flow path shape of the rim conduit 42, so that the water can be prevented from running out. This makes it possible to suppress the lowering in the flow velocity of the washing water W22 supplied from the rim spout 43 (low-flow rate spout 431) when the washing water W21 flowing through the rim conduit 42 is of a low flow rate, thereby suppressing the deterioration in the washing performance of the bowl portion 21.

In addition, the fact that the rim conduit has the agitation chamber 44 having a flow-path cross-sectional area larger than a flow-path cross-sectional area of the low-flow rate spout on the upstream side of the low-flow rate spout makes the flow of the washing water W21 to be turbulent in the agitation chamber 44 and makes the washing water W21 flow into the low-flow rate spout 431 in the turbulent flow, making it easier for the low-flow rate spout 431 to be more watertight. This makes it possible to suppress the lowering in the flow velocity of the washing water W22 supplied from the rim spout 43 (low-flow rate spout 431) when the washing water W21 flowing through the rim conduit 42 is of a low flow rate, thereby suppressing the deterioration in the washing performance of the bowl portion 21.

Because the rim conduit 42 branches off from the main conduit 31 on the upstream side of the jet conduit 51, the flow velocity of the washing water W21 flowing into the rim conduit 42 does not affect the jet spout having a high flow velocity, and the flow velocity of the washing water W21 flowing into the rim conduit 42 from the main conduit 31 can be regulated by the pressure-rate control portion 45. As a result, when the washing water W21 flowing through the rim conduit 42 is of a low flow rate, the washing water W22 is supplied to the bowl portion 21 from the low-flow rate spout 431, making it possible to suppress the lowering in the flow velocity of the washing water W22 supplied from the rim spout 43 (low-flow rate spout 431), and to suppress the deterioration in the washing performance of the bowl portion 21. Meanwhile, when the washing water W21 flowing through the rim conduit 42 is of a high flow rate, the flow velocity of the washing water W22 supplied from the rim spout 43 (high-flow rate spout 432) can be suppressed from increasing excessively, thereby preventing the washing water W from jumping out from the bowl portion 21.

The flow-path cross-sectional area S2 of the low-flow rate spout 431 is larger than the flow-path cross-sectional area S5 of the pressure-rate control portion 45, and the flow-path cross-sectional area S3 of the high-flow rate spout 432 and the flow-path cross-sectional area S4 of the agitation chamber 44 are both larger than the flow-path cross-sectional area S2 of the low-flow rate spout 431, so that the washing water distribution in the pressure-rate control portion 45 can be determined and, when the washing water W21 flowing through the rim conduit 42 is of a low flow rate, the washing water W can be regulated at the small flow-path cross-sectional area S2 of the low-flow rate spout 431.

The central axis L1 in the flow direction of the washing water W21 in the pressure-rate control portion 45 is located above the central axis L2 in the flow direction of the washing water W21 in the low-flow rate spout 431, so that the washing water W21 accelerated in the pressure-rate control portion 45 does not flow directly into the low-flow rate spout 431, but flows into the low-flow rate spout 431 after being in a turbulent and swirling state in the agitation chamber 44, making it easier for the low-flow rate spout 431 to be watertight. This makes it possible to suppress the lowering in the flow velocity of the washing water W22 supplied from the rim spout 43 (low-flow rate spout 431) when the washing water W21 flowing through the rim conduit 42 is of a low flow rate, thereby suppressing the deterioration in the washing performance of the bowl portion 21.

The agitation chamber 44 has a wall portion 441 on the upstream side of the low-flow rate spout 431, so that the washing water W21 accelerated in the pressure-rate control portion 45 flows into the low-flow rate spout 431 after colliding with the wall portion 441, which makes the flow be in a turbulent and swirling state in the agitation chamber 44 and makes the low-flow rate spout 431 easier to be watertight. This makes it possible to suppress the lowering in the flow velocity of the washing water W22 supplied from the rim spout 43 (low-flow rate spout 431) when the washing water W21 flowing through the rim conduit 42 is of a low flow rate, thereby suppressing the deterioration in the washing performance of the bowl portion 21.

2. Second Embodiment

Figure 7:
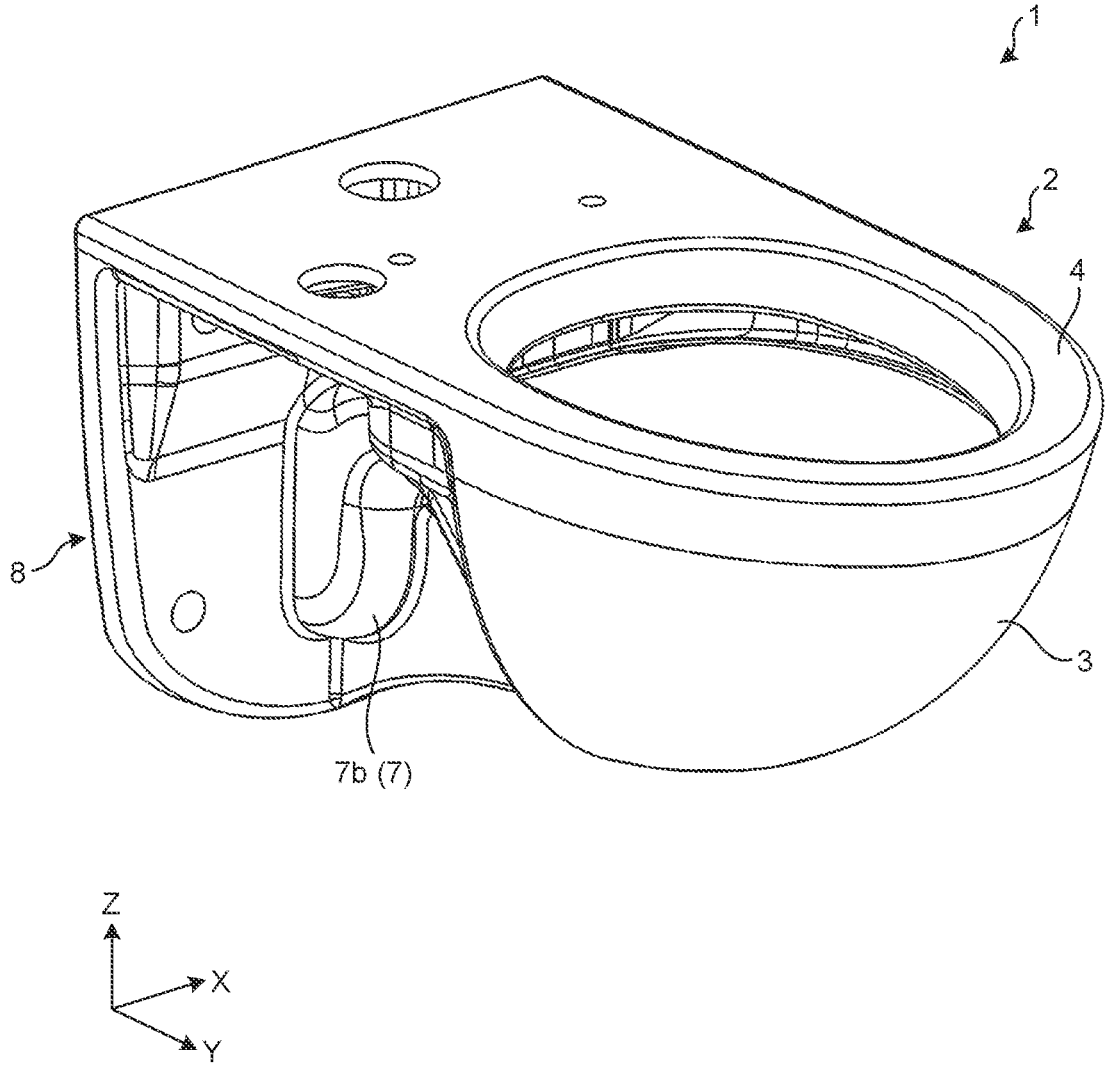
FIG. 7 is a perspective view of a flush toilet according to a second embodiment.
Figure 8:
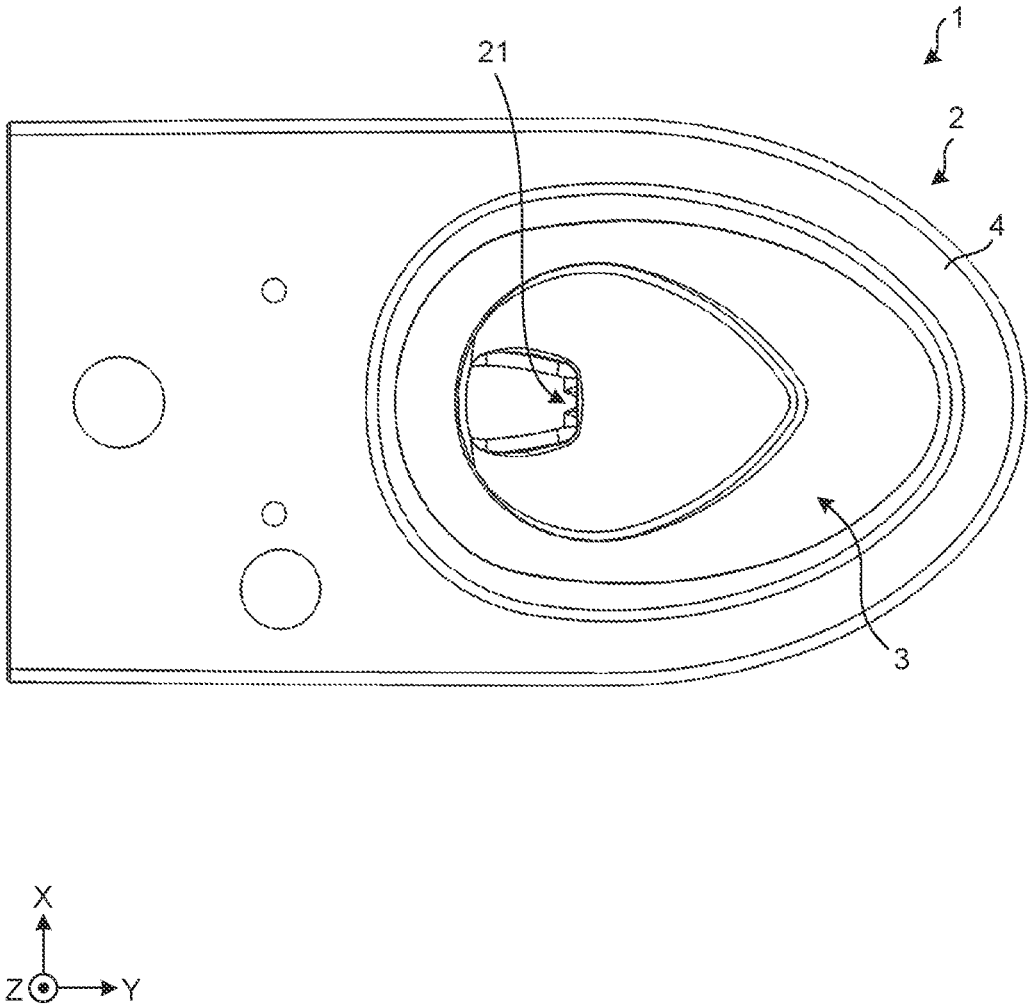
FIG. 8 is a plan view of the flush toilet in the second embodiment.
Figure 9:
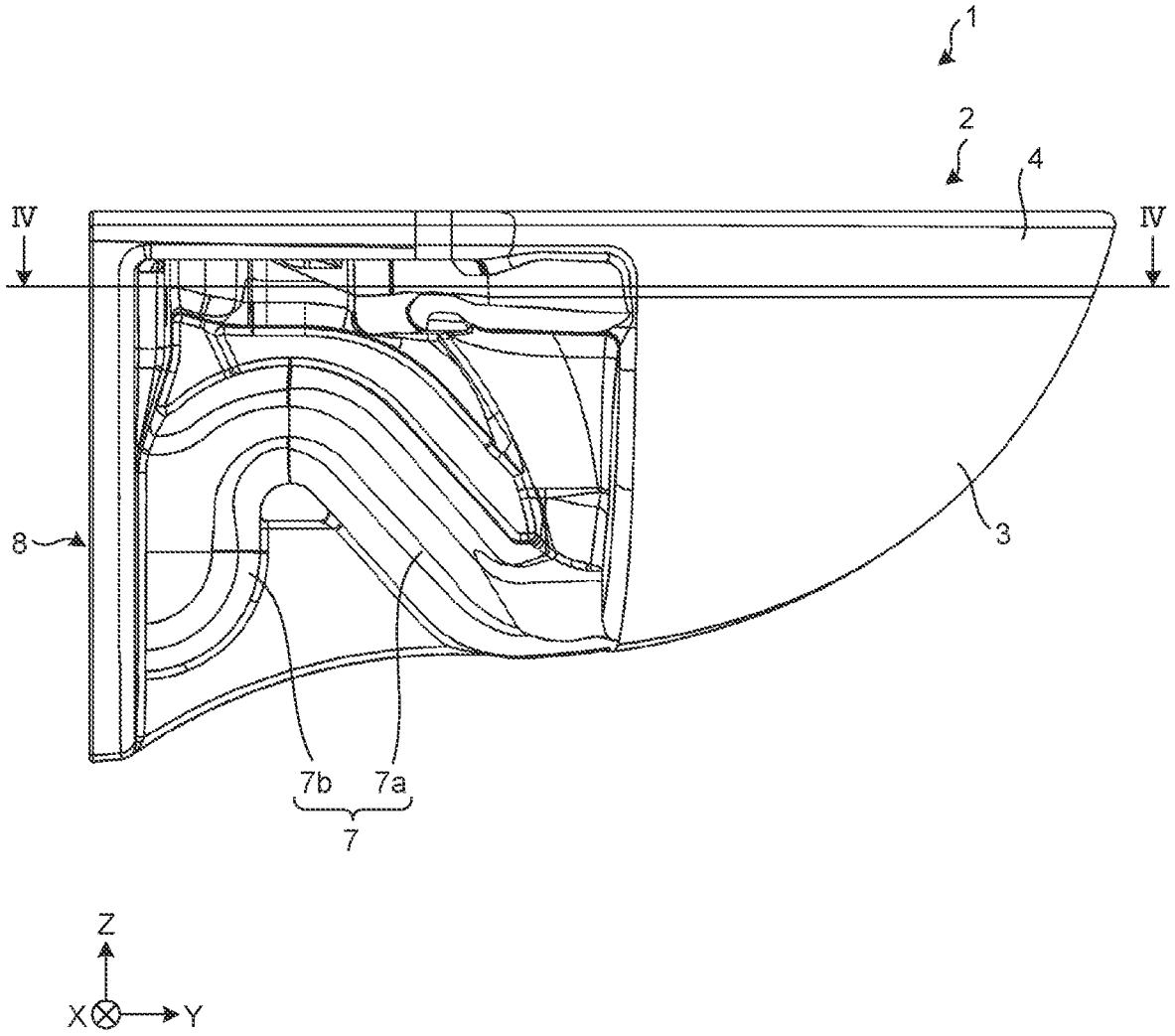
FIG. 9 is a side view of the flush toilet in the second embodiment.
Figure 10:
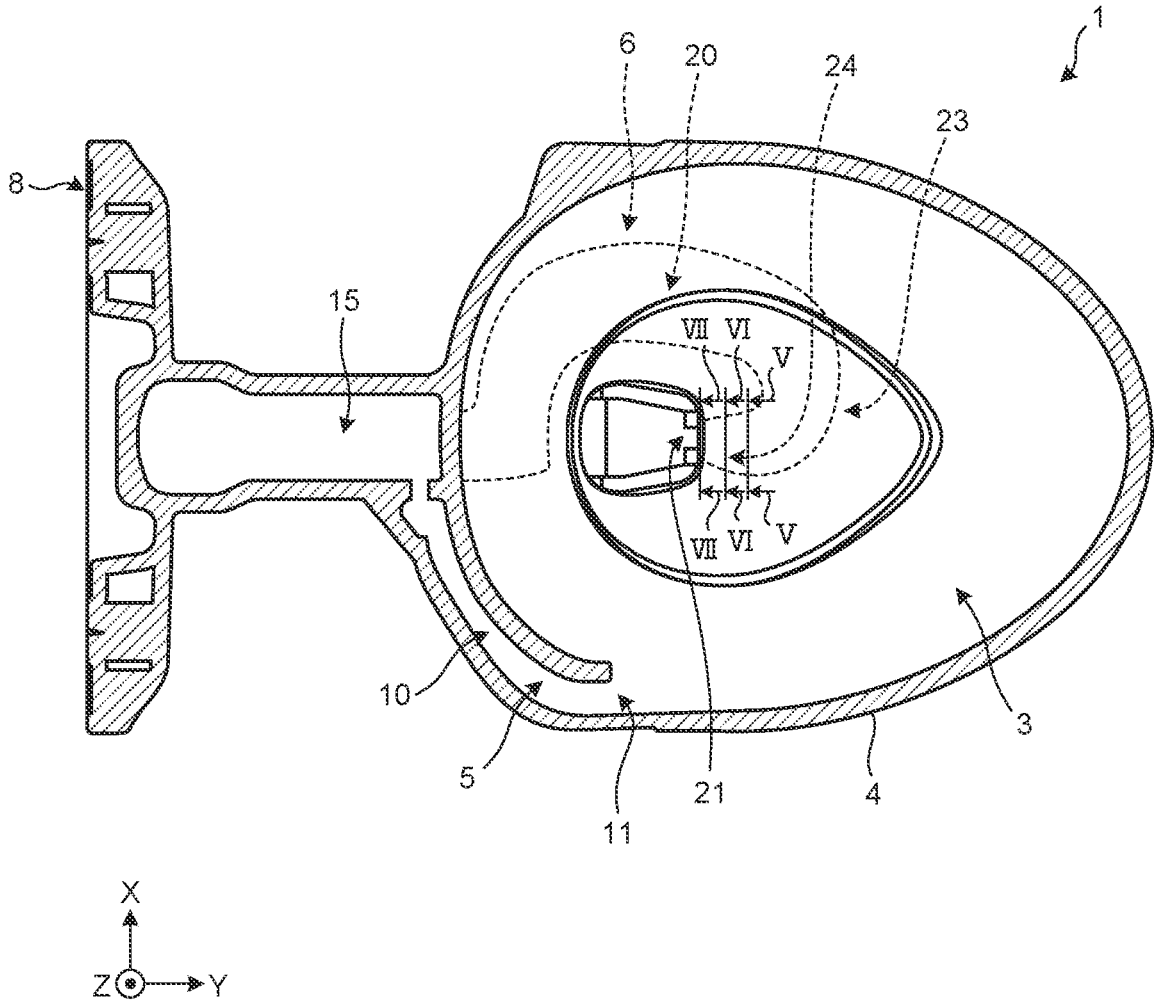
FIG. 10 is a IV-IV cross-sectional view in FIG. 9.
Figure 11:
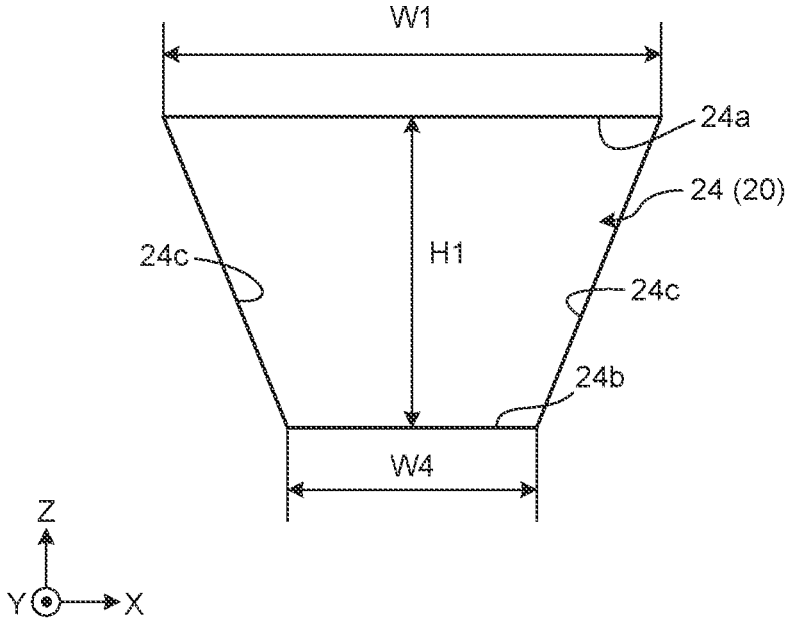
FIG. 11 is a schematic diagram illustrating the shape of a jet conduit at the V-V cross-section in FIG. 10.
Figure 12:
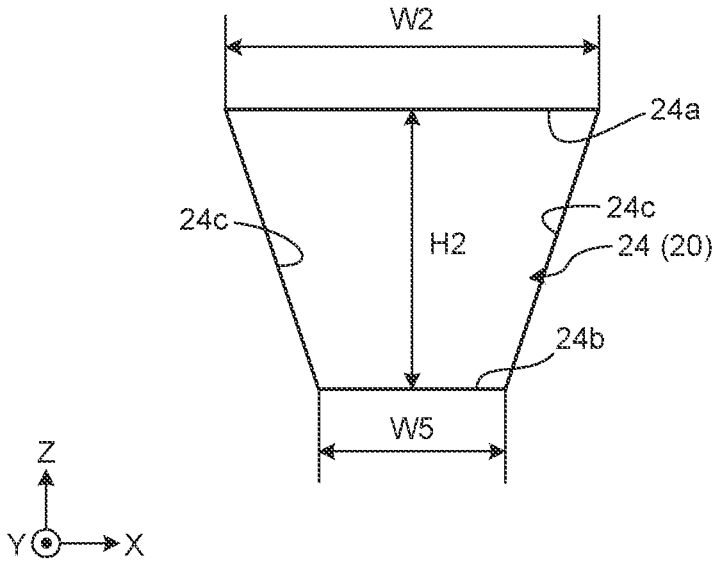
FIG. 12 is a schematic diagram illustrating the shape of the jet conduit at the VI-VI cross-section in FIG. 10.
Figure 13:
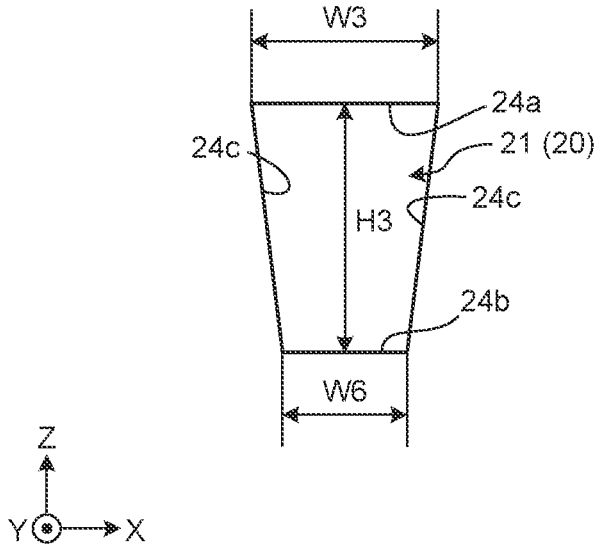
FIG. 13 is a schematic diagram illustrating the shape of the jet conduit at the VII-VII cross-section in FIG. 10.

A flush toilet 1 according to a second embodiment will be described with reference to FIG. 7 through FIG. 13. FIG. 7 is a perspective view of the flush toilet 1 according to the second embodiment. FIG. 8 is a plan view of the flush toilet 1 in the second embodiment. FIG. 9 is a side view of the flush toilet 1 in the second embodiment. FIG. 10 is a IV-IV cross-sectional view in FIG. 9. FIG. 11 is a schematic diagram illustrating the shape of a jet conduit 20 at the V-V cross-section in FIG. 10. FIG. 12 is a schematic diagram illustrating the shape of the jet conduit 20 at the VI-VI cross-section in FIG. 10. FIG. 13 is a schematic diagram illustrating the shape of the jet conduit 20 at the VII-VII cross-section in FIG. 10.

In FIG. 7 and others, to make the explanation easier to understand, a three-dimensional Cartesian coordinate system including the Z-axis with the vertical upward direction as the positive direction is indicated. In the Cartesian coordinate system, it is defined that the X-axis positive direction is leftward and the X-axis negative direction is rightward. Furthermore, it is defined that the Y-axis positive direction is forward and the Y-axis negative direction is rearward. The X-axis direction is referred to as the left-and-right direction, the Y-axis direction is referred to as the front-and-back direction, and the Z-axis direction is referred to as the up-and-down direction.

The flush toilet 1 is installed in a toilet room. The flush toilet 1 is a wall-hung type that is mounted on the wall surface of the toilet room. The flush toilet 1 may be a floor-mounted type installed on the floor of the toilet room.

The flush toilet 1 is equipped with a toilet bowl body 2. The flush toilet 1 is equipped with functional portions that are attached to the toilet bowl body 2. The functional portions include, for example, a toilet seat, a sanitary washing device, a water storage tank, and a pressurized pump.

The toilet bowl body 2 is made of ceramic, for example. The toilet bowl body 2 is provided with a bowl portion 3, a rim portion 4, a rim spout portion 5, a jet spout portion 6, a drain trap 7 (trap portion), and a mounting portion 8. The bowl portion 3 receives the waste of a user. The rim portion 4 is formed at the upper edge of the bowl portion 3.

The rim spout portion 5 includes a rim conduit 10 and a rim spout 11. The rim conduit 10 communicates with a common conduit 15. The common conduit 15 is provided behind the bowl portion 3. The common conduit 15 is supplied with washing water from the water storage tank. The rim conduit 10 is formed along the rim portion 4 from the rear of the bowl portion 3 toward the right.

The rim spout 11 is formed at the distal end of the rim conduit 10. The rim spout 11 is formed at the distal end of the rim conduit 10 in the flow direction of the washing water, that is, at the downstream end of the rim conduit 10 in the flow direction of the washing water. The rim spout 11 is formed on the right side of the rim portion 4. The rim spout 11 discharges the washing water flowing through the rim conduit 10 to the rim portion 4. The washing water discharged from the rim spout 11 flows into the bowl portion 3 while swirling along the rim portion 4, and forms a swirling flow. By the swirling flow thus formed, the bowl portion 3 is washed. The waste in the bowl portion 3 is swept to the bottom of the bowl portion 3 by the swirling flow.

The jet spout portion 6 jets the washing water from the front of the drain trap 7 toward the drain trap 7. The jet spout portion 6 includes a jet conduit 20 and a jet spout 21. The jet conduit 20 communicates with the common conduit 15. The jet conduit 20 is formed from the rear of the bowl portion 3 toward the left. The jet conduit 20 is formed obliquely downward from the rear of the bowl portion 3 along the bowl portion 3.

The jet conduit 20 includes a curved portion 23 and a contracted portion 24. The curved portion 23 is provided forward of the drain trap 7. The curved portion 23 is formed so as to change the flow of the washing water flowing from backward to forward through the jet conduit 20 to flowing from forward to backward. In the flow direction of the washing water flowing through the jet conduit 20, the downstream end of the curved portion 23 is connected to the contracted portion 24.

The contracted portion 24 is provided forward of the drain trap 7. The contracted portion 24 is provided so that its cross-sectional area in the cross-section orthogonal to the front-and-back direction decreases from the front toward the rear. The contracted portion 24 may be provided such that, in the flow direction of the washing water flowing through the contracted portion 24, the cross-sectional area in the cross-section orthogonal to the flow direction of the washing water flowing through the contracted portion 24 decreases from the upstream side toward the downstream side.

The jet spout 21 is formed at the distal end of the jet conduit 20. That is, the jet spout 21 is formed at the distal end of the contracted portion 24. The jet spout 21 is formed at the distal end in the flow direction of the washing water in the jet conduit 20, that is, at the downstream end in the flow direction of the washing water in the jet conduit 20. The jet spout 21 jets the washing water flowing through the jet conduit 20 toward the drain trap 7. The washing water jetted out from the jet spout 21 flows into the drain trap 7 while entangling the pooled water reserved in the bowl portion 3. As a result, the waste washed away by the washing water discharged from the rim spout 11 is discharged into the drain trap 7.

For example, as illustrated in FIG. 11 to FIG. 13, in the contracted portion 24, the cross-sectional area in the cross-section orthogonal to the front-and-back direction decreases from the front toward the rear. FIG. 13 is a cross-sectional view of the contracted portion 24 including the jet spout 21.

The cross-sectional area of the jet spout 21 is the smallest of all the cross-sectional areas of the jet conduit 20. The width of a top surface 24*a* of the contracted portion 24 gradually shortens from the front toward the rear. The width of the top surface 24*a* of the contracted portion 24 varies from W1 to W2 and then to W3, from the front toward the rear in the cross sections illustrated in FIG. 11 to FIG. 13.

The width of a bottom surface 24*b* of the contracted portion 24 gradually shortens from the front toward the rear. The width of the bottom surface 24*b* of the contracted portion 24 varies from W4 to W5 and then to W6, from the front toward the rear in the cross sections illustrated in FIG. 11 to FIG. 13. The width of the top surface 24*a* of the contracted portion 24 and the width of the bottom surface 24*b* of the contracted portion 24 are the length of the top surface 24*a* in the left-and-right direction and the length of the bottom surface 24*b* in the left-and-right direction, respectively.

The reduction ratio in the width of the top surface 24*a* of the contracted portion 24 is smaller than the reduction ratio in the width of the bottom surface 24*b* of the contracted portion 24. The reduction ratio is the ratio of the downstream width of the washing water flowing through the jet conduit 20 to the upstream width of the washing water flowing through the jet conduit 20. The reduction ratio is calculated by dividing the downstream width of the washing water flowing through the jet conduit 20 by the upstream width of the washing water flowing through the jet conduit 20.

The reduction ratio r1 of the width of the top surface 24*a* of the contracted portion 24 is W3/W1. The reduction ratio r2 of the width of the bottom surface 24*b* of the contracted portion 24 is W6/W4. The reduction ratio r1 of the width of the top surface 24*a* of the contracted portion 24 is smaller than the reduction ratio r2 of the width of the bottom surface 24*b* of the contracted portion 24.

The reduced width of the top surface 24*a* of the contracted portion 24 is larger than the reduced width of the bottom surface 24*b* of the contracted portion 24. The reduced width is the difference between the upstream width of the washing water flowing through the jet conduit 20 and the downstream width of the washing water flowing through the jet conduit 20. The reduced width d1 of the width in the top surface 24*a* of the contracted portion 24 is W1-W3. The reduced width d2 of the width in the bottom surface 24*b* of the contracted portion 24 is W4-W6. The reduced width d1 of the width in the top surface 24*a* of the contracted portion 24 is greater than the reduced width d2 of the width in the bottom surface 24*b* of the contracted portion 24.

The height from the bottom surface 24*b* of the contracted portion 24 to the top surface 24*a* of the contracted portion 24 gradually lowers from the front toward the rear. The height from the bottom surface 24*b* of the contracted portion 24 to the top surface 24*a* of the contracted portion 24 varies from H1 to H2 and then to H3, from the front toward the rear in the cross sections illustrated in FIG. 11 to FIG. 13.

The angle that is formed between at least one side surface 24*c*, among the side surfaces 24*c* connecting the top surface 24*a* of the contracted portion 24 and the bottom surface 24*b* of the contracted portion 24, and the top surface 24*a* of the contracted portion 24 is an acute angle. For example, the contracted portion 24 is formed so that the angles that are formed between the two sides 24*c* and the top surface 24*a* are acute angles.

The distance between the side surfaces 24*c* of the contracted portion 24 gradually shortens from the front toward the rear. That is, the distance between the side surfaces 24*c* of the contracted portion 24 gradually shortens toward the jet spout 21 side. The distance between the side surfaces 24*c* of the contracted portion 24 is the distance between the two side surfaces 24*c* facing each other.

The drain trap 7 communicates with the bottom of the bowl portion 3. The drain trap 7 extends from the bottom of the bowl portion 3 and discharges the waste in the bowl portion 3. The drain trap 7 includes an ascending pipe 7*a* and a descending pipe 7*b*.

The ascending pipe 7*a* communicates with the lower end of the bowl portion 3. The ascending pipe 7*a* extends obliquely upward from the lower end of the bowl portion 3 toward the sidewall surface side, that is, toward the rear.

The descending pipe 7*b* is connected to the rear end of the ascending pipe 7*a*. The descending pipe 7*b* is connected to a drain pipe provided on the wall surface via a drain socket.

The mounting portion 8 is provided between the bowl portion 3 and the wall surface. The mounting portion 8 is provided at the rear end of the toilet bowl body 2. The mounting portion 8 mounts the flush toilet 1 on the wall surface via a mounting member. The mounting member is bolts and nuts, for example.

The flush toilet 1 is provided with the contracted portion 24 where the cross-sectional area of the jet conduit 20 becomes smaller in the flow direction of the washing water, so that the change in the flow velocity of the washing water flowing through the jet conduit 20 is likely to occur. Therefore, the air in the jet conduit 20, for example, the air contained in the washing water flowing through the jet conduit 20 and the air accumulated in the jet conduit 20, is subdivided by the contracted portion 24.

In the contracted portion 24, the reduction ratio at the top surface 24*a* is smaller than the reduction ratio at the bottom surface 24*b*. Therefore, in the contracted portion 24, the change in the flow velocity of the washing water is further likely to occur, so that the air in the jet conduit 20 is subdivided by the contracted portion 24.

Moreover, the angle between the top surface 24*a* of the contracted portion 24 and the side surface 24*c* of the contracted portion 24 is formed at an acute angle, so that the air that is accumulated between the top surface 24*a* and the side surface 24*c* is subdivided by the washing water near the top surface 24*a* having a slow flow velocity.

As the air in the jet conduit 20 is subdivided, pressure changes in the jet conduit 20 due to air bursts are suppressed. As a result, the generation of abnormal noise of the washing water flowing through the jet conduit 20 and the generation of abnormal noise of the washing water jetted from the jet spout 21 are suppressed.

The flush toilet 1 is equipped with the bowl portion 3, the drain trap 7, and the jet spout portion 6. The bowl portion 3 receives the waste. The drain trap 7 communicates with the bowl portion 3 so as to discharge the waste from the bowl portion 3. The jet spout portion 6 jets the washing water from the front of the drain trap 7 toward the drain trap 7. The jet spout portion 6 includes the jet conduit 20 and the jet spout 21. The jet conduit 20 is formed so that the washing water flows through it. The jet spout 21 is formed at the distal end of the jet conduit 20 and jets the washing water toward the drain trap 7. The jet conduit 20 includes the contracted portion 24. The contracted portion 24 has a cross-sectional area that becomes smaller toward the jet spout 21 side. The cross-sectional area of the jet spout 21 is the smallest of all the cross-sectional areas of the jet conduit 20. The reduction ratio in the width of the top surface 24*a* of the contracted portion 24 in the flow direction of the washing water in the jet conduit 20 is smaller than the reduction ratio in the width of the bottom surface 24*b* of the contracted portion 24 in the flow direction of the washing water in the jet conduit 20. The angle that is formed between at least one side surface 24*c*, among the side surfaces 24*c* of the contracted portion 24, and the top surface 24*a* of the contracted portion 24 is an acute angle.

This enables the flush toilet 1 to subdivide the air in the jet conduit 20 by causing changes in the flow velocity of the washing water in the contracted portion 24. Furthermore, by increasing the change in the flow velocity of the washing water on the top surface 24*a* side of the contracted portion 24, the flush toilet 1 can subdivide the air suspended on the top surface 24*a* side of the contracted portion 24. By making the angle that is formed between the side surface 24*c* of the contracted portion 24 and the top surface 24*a* of the contracted portion 24 be an acute angle, the flush toilet 1 can subdivide the air accumulated between the top surface 24*a* and the side surface 24*c* by the washing water near the top surface 24*a* having a slow flow velocity. As a result, the flush toilet 1 can suppress pressure changes in the jet conduit 20 and reduce the generation of abnormal noise.

The jet conduit 20 includes the curved portion 23. The curved portion 23 is connected to the contracted portion 24 and changes the flow direction of the washing water in a direction from backward to forward, to a direction from forward to backward.

This enables the flush toilet 1 to subdivide the air at the contracted portion 24 provided on the downstream side of the curved portion 23 in the flow direction of the washing water flowing through the jet conduit 20. Therefore, the flush toilet 1 can jet the washing water, including subdivided air, from the jet spout 21. Consequently, the flush toilet 1 can suppress the generation of abnormal noise caused by the washing water jetted from the jet spout 21.

The distance between the top surface 24*a* of the contracted portion 24 and the bottom surface 24*b* of the contracted portion 24 gradually shortens toward the jet spout 21 side.

As a result, the flush toilet 1 can jet the washing water having little bias in the up-and-down direction from the jet spout 21 while suppressing the generation of abnormal noise in the jet conduit 20. Therefore, the flush toilet 1 can prevent the discharge performance of waste by the washing water jetted from the jet spout 21 from deteriorating while suppressing the generation of abnormal noise.

The distance between the side surfaces 24*c* of the contracted portion 24 gradually shortens toward the jet spout 21 side.

As a result, the flush toilet 1 can jet the washing water having little bias in the left-and-right direction from the jet spout 21 while suppressing the generation of abnormal noise in the jet conduit 20. Therefore, the flush toilet 1 can prevent the discharge performance of waste by the washing water jetted from the jet spout 21 from deteriorating while suppressing the generation of abnormal noise.

The flush toilet 1 according to a modification may, in the curved portion 23, have a cross-sectional area that becomes smaller toward the jet spout 21. The flush toilet 1 in the modification may, in the jet conduit 20 on the upstream side of the curved portion 23, have a cross-sectional area that becomes smaller toward the jet spout 21. That is, the contracted portion 24 may include the curved portion 23, and the jet conduit 20 on the upstream side of the curved portion 23.

This enables the flush toilet 1 in the modification to subdivide the air in the jet conduit 20. Therefore, the flush toilet 1 in the modification can suppress pressure changes in the jet conduit 20 and prevent the generation of abnormal noise.

In the flush toilet 1 in the modification, an angle formed between at least one side surface, among the side surfaces of the curved portion 23, and the top surface of the curved portion 23 may be an acute angle. In the flush toilet 1 in the modification, an angle formed between at least one side surface, among the side surfaces of the jet conduit 20 on the upstream side of the curved portion 23, and the top surface of the jet conduit 20 may be an acute angle. In the flush toilet 1 in the modification, an angle between the side surface 24*c* of the contracted portion 24 and the top surface 24*a* of the contracted portion 24 may be not an acute angle. For example, the side surface 24*c* of the contracted portion 24 and the top surface 24*a* of the contracted portion 24 may be orthogonal. That is, the angle formed between at least one side surface, among the side surfaces of the jet conduit 20, and the top surface of the jet conduit 20 only needs to be an acute angle.

This enables the flush toilet 1 in the modification to subdivide the air accumulated between the top surface of the jet conduit 20 and the side surfaces of the jet conduit 20. Therefore, the flush toilet 1 in the modification can suppress pressure changes in the jet conduit 20 and prevent the generation of abnormal noise.

The flush toilet 1 in the modification may have the top surface 24*a* of the contracted portion 24 protruded downward. For example, the top surface 24*a* of the contracted portion 24 is formed so that the center of the top surface 24*a* in the left-and-right direction protrudes downward. In this case, the width of the top surface 24*a* is, in the left-and-right direction, the length of the top surface 24*a* including the protruded point.

3. Third Embodiment

Figure 14:
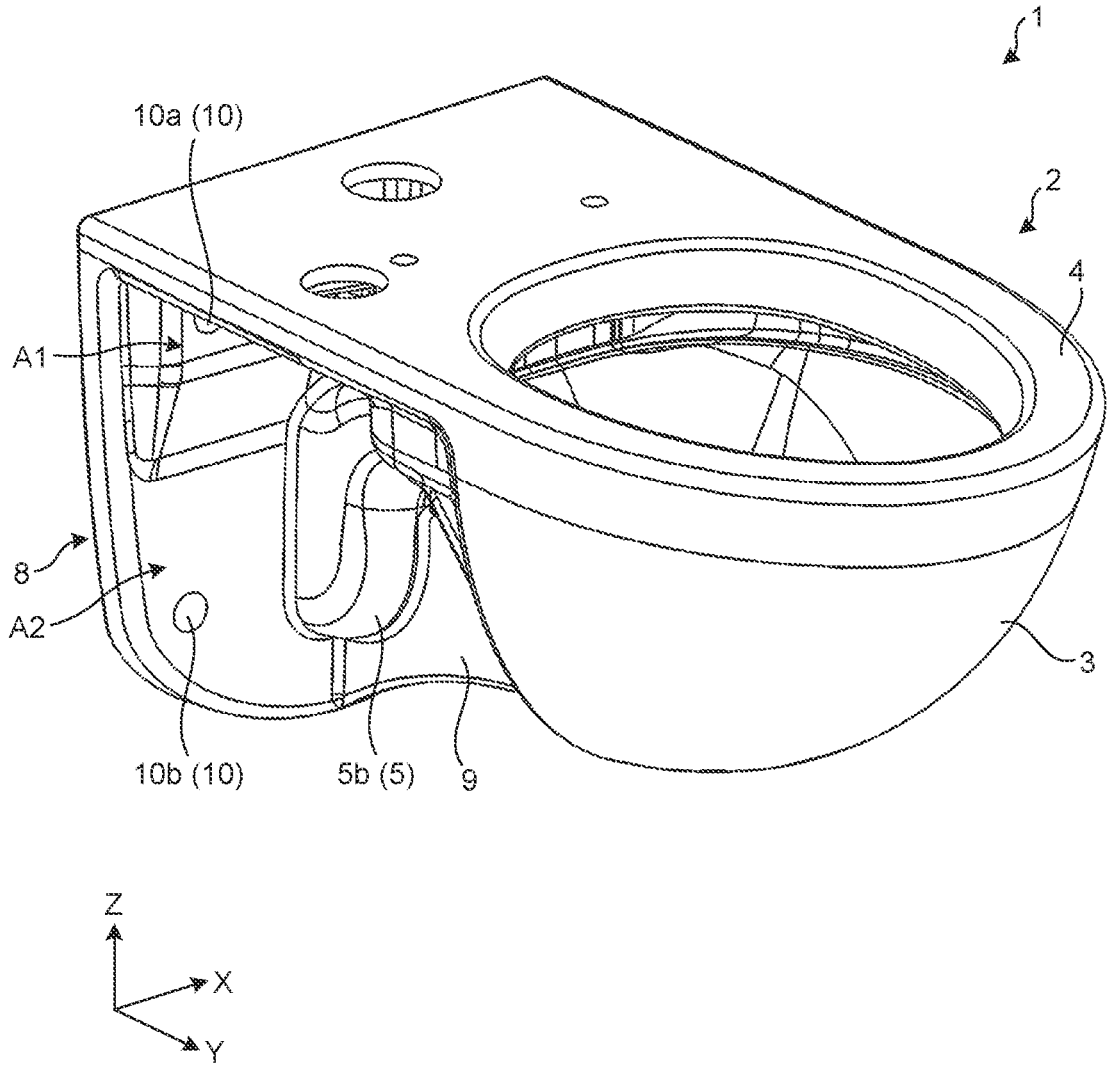
FIG. 14 is a perspective view of a flush toilet according to a third embodiment.
Figure 15:
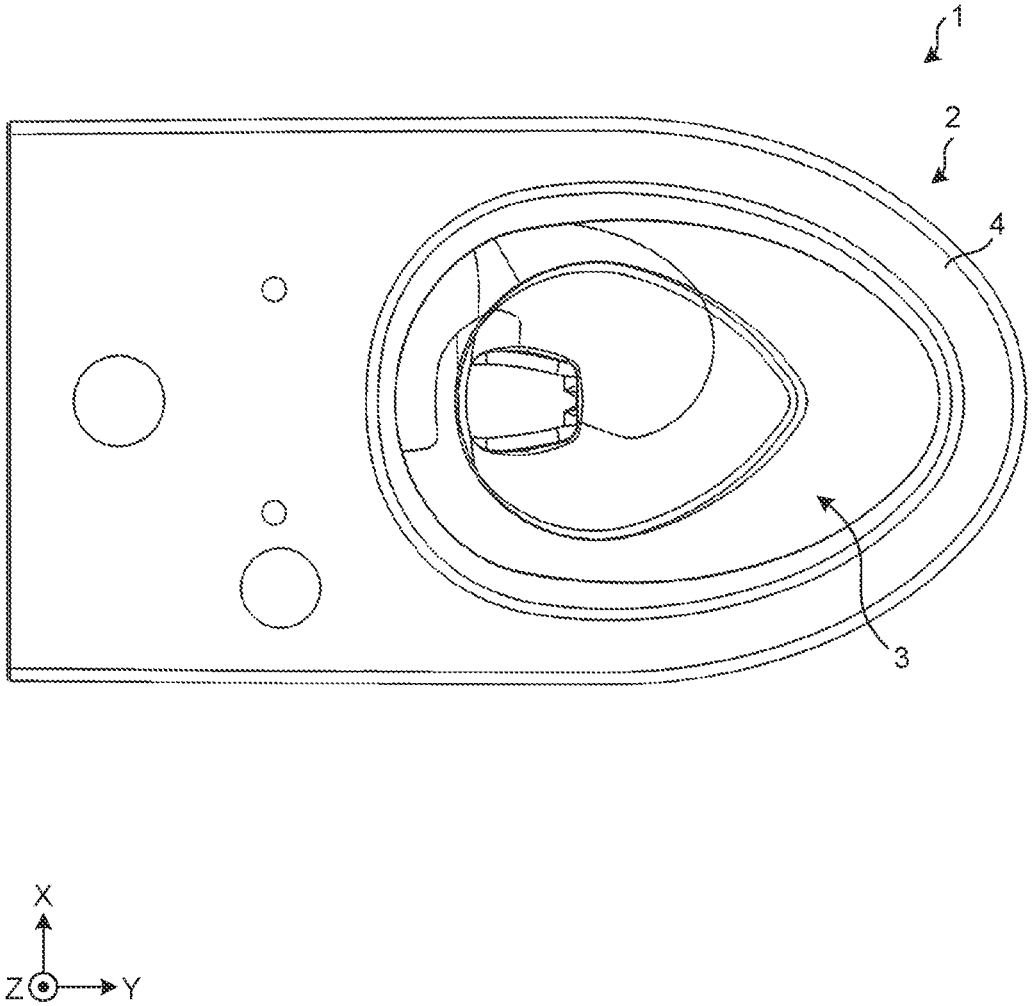
FIG. 15 is a plan view of the flush toilet in the third embodiment.
Figure 16:
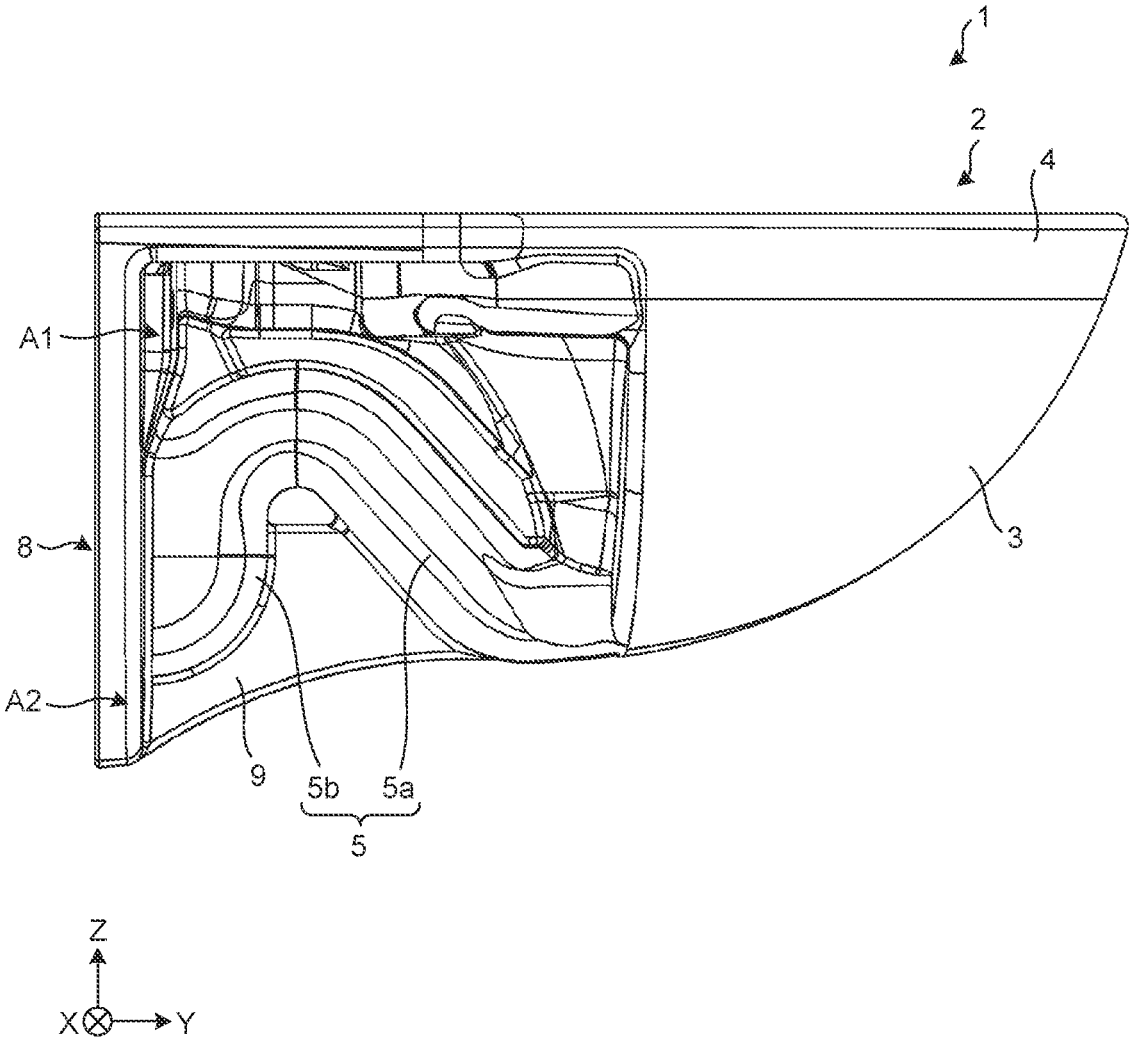
FIG. 16 is a side view of the flush toilet in the third embodiment.
Figure 17:
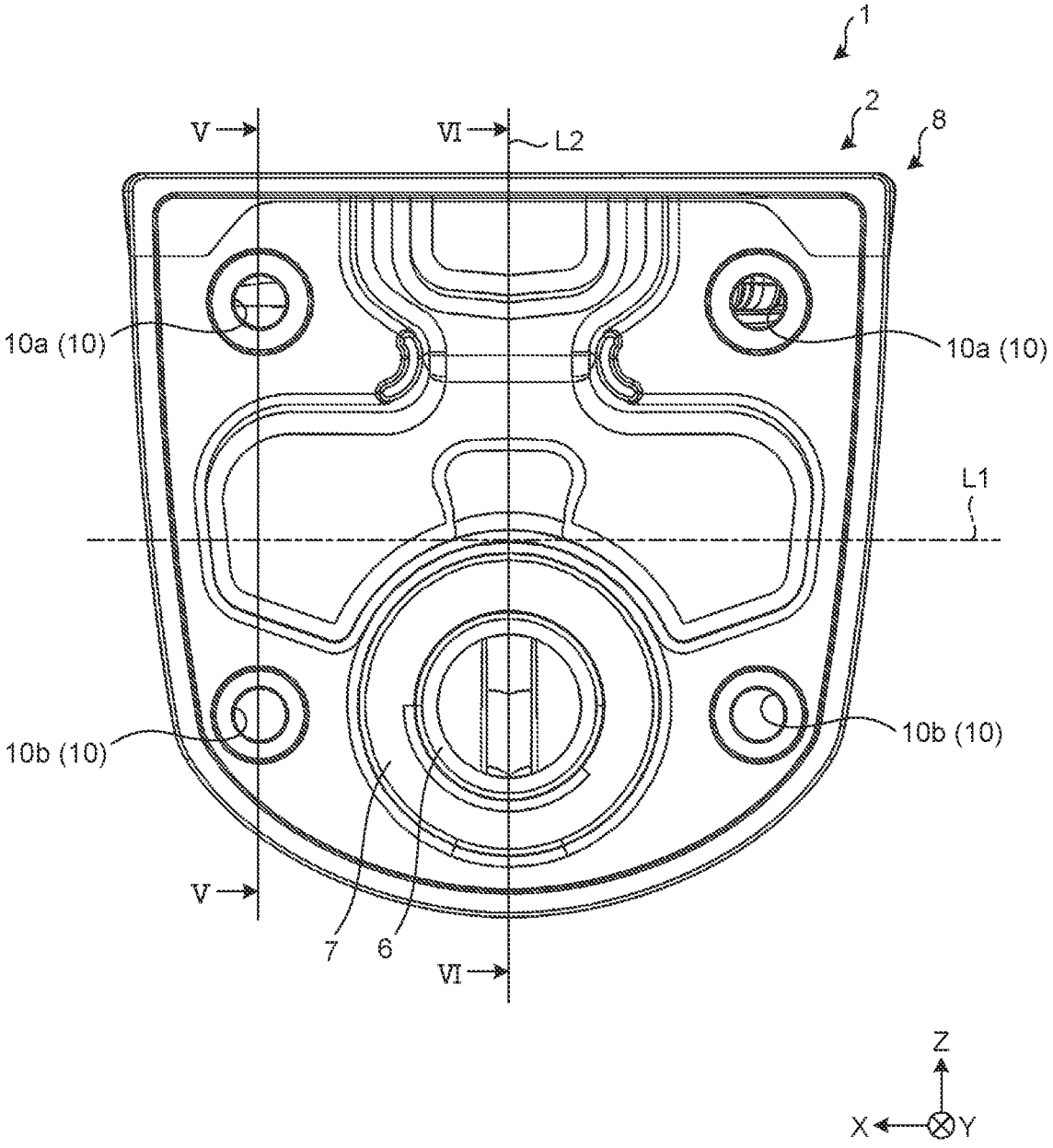
FIG. 17 is a rear view of the flush toilet in the third embodiment.
Figure 18:
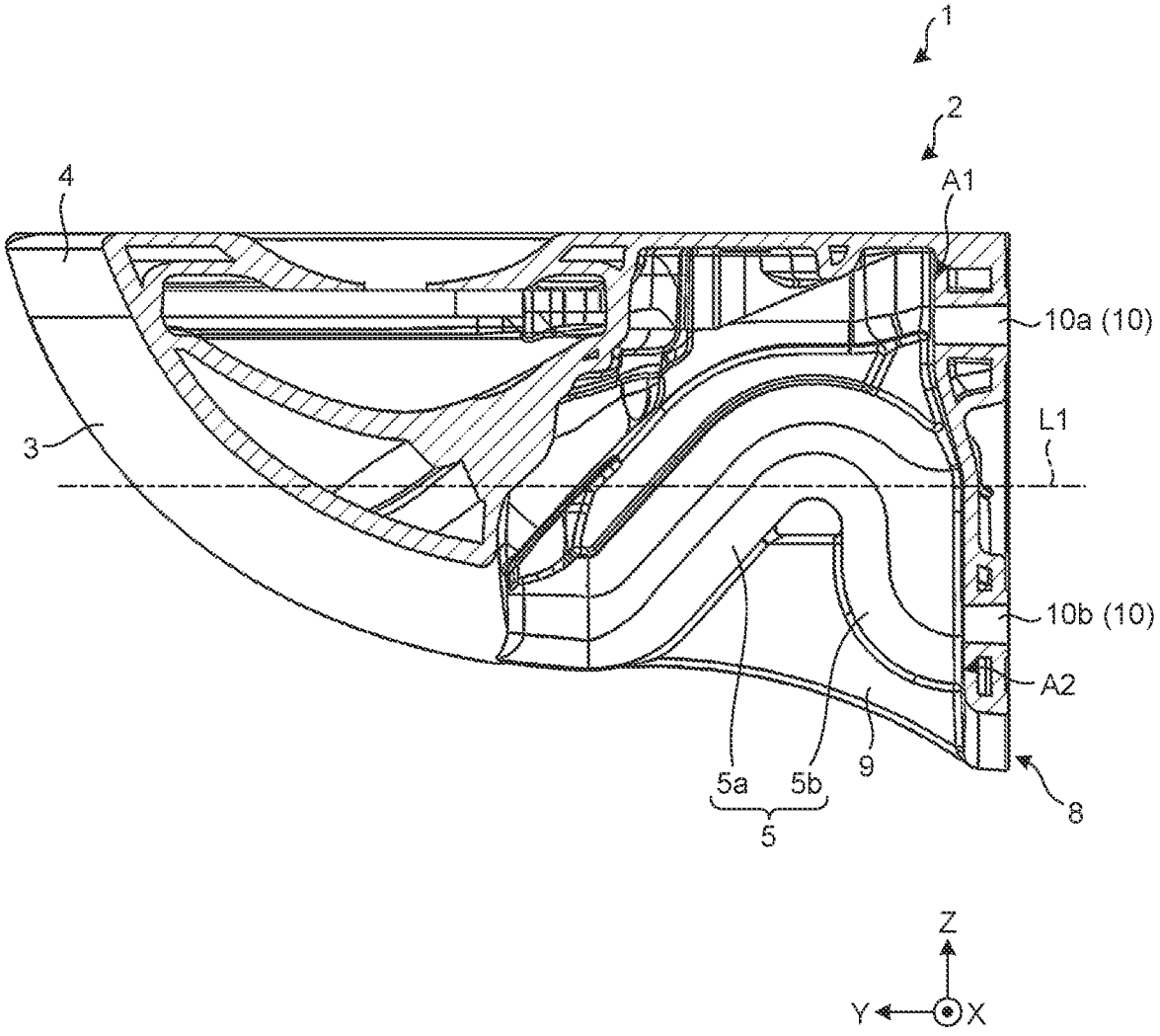
FIG. 18 is a V-V cross-sectional view in FIG. 17.
Figure 19:
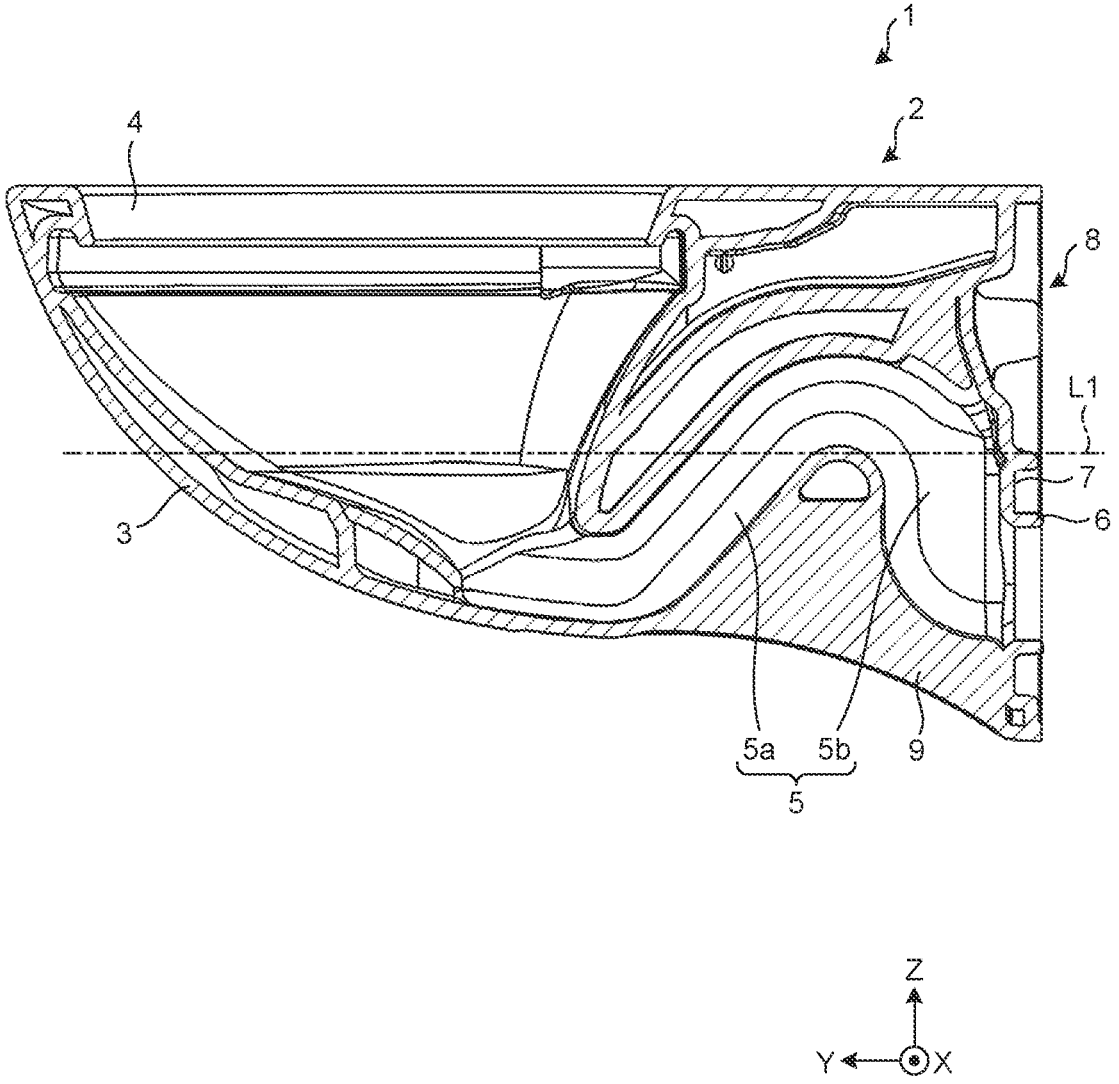
FIG. 19 is a VI-VI cross-sectional view in FIG. 17.

A flush toilet 1 according to a third embodiment will be described with reference to FIG. 14 through FIG. 18. FIG. 14 is a perspective view of the flush toilet 1 in the third embodiment. FIG. 15 is a plan view of the flush toilet 1 in the third embodiment. FIG. 16 is a side view of the flush toilet 1 in the third embodiment. FIG. 17 is a rear view of the flush toilet 1 in the third embodiment. FIG. 18 is a V-V cross sectional view in FIG. 17. FIG. 19 is a VI-VI cross-sectional view in FIG. 17.

In FIG. 14 and others, to make the explanation easier to understand, a three-dimensional Cartesian coordinate system including the Z-axis with the vertical upward direction as the positive direction is indicated. In the Cartesian coordinate system, it is defined that the X-axis positive direction is leftward and the X-axis negative direction is rightward. Furthermore, it is defined that the Y-axis positive direction is forward and the Y-axis negative direction is rearward. The X-axis direction is referred to as the left-and-right direction, the Y-axis direction is referred to as the front-and-back direction, and the Z-axis direction is referred to as the up-and-down direction.

The flush toilet 1 is installed in a toilet room. The flush toilet 1 is a wall-hung type that is mounted on the wall surface of the toilet room. The flush toilet 1 is equipped with a toilet bowl body 2. The flush toilet 1 is equipped with functional portions that are attached to the toilet bowl body 2. The functional portions include, for example, a toilet seat, a sanitary washing device, a water storage tank, and a pressurized pump.

The toilet bowl body 2 is made of ceramic, for example. The toilet bowl body 2 includes a bowl portion 3, a rim portion 4, a drain trap 5 (trap portion), a drain socket 6, a drain flange portion 7, a mounting portion 8, and a modesty panel 9. The bowl portion 3 receives the waste of a user. The rim portion 4 is formed at the upper edge of the bowl portion 3.

The drain trap 5 communicates with the bottom of the bowl portion 3. The drain trap 5 extends from the bottom of the bowl portion 3 and discharges the waste in the bowl portion 3. The drain trap 5 includes an ascending pipe 5*a* and a descending pipe 5*b*.

The ascending pipe 5*a* communicates with the lower end of the bowl portion 3. The ascending pipe 5*a* extends obliquely upward from the lower end of the bowl portion 3 toward the sidewall surface side, that is, toward the rear.

The descending pipe 5*b* connects the ascending pipe 5*a* and the drain socket 6. The descending pipe 5*b* is connected to the rear end of the ascending pipe 5*a*. The descending pipe 5*b* extends obliquely downward from the upper end of the ascending pipe 5*a* toward the drain socket 6. The drain trap 5 is provided so that the lower end of the ascending pipe 5*a* is below the lower end of the descending pipe 5*b*. The drain trap 5 may be provided so that the lower end of the ascending pipe 5*a* is above the lower end of the descending pipe 5*b*. The drain trap 5 may be provided so that the lower end of the ascending pipe 5*a* is at the same height as the lower end of the descending pipe 5*b*.

The drain socket 6 is connected to the rear end of the descending pipe 5*b*. The drain socket 6 is connected to a drain pipe provided on the wall surface. That is, the drain socket 6 connects the drain trap 5 to the drain pipe. The drain socket 6 is provided below the first virtual centerline L1 of the mounting portion 8 in the up-and-down direction.

The drain flange portion 7 is provided around the drain socket 6. The drain flange portion 7 is provided forward of the rear end of the drain socket 6. The drain flange portion 7 is provided below the first virtual centerline L1.

The mounting portion 8 is provided between the bowl portion 3 and the wall surface. The mounting portion 8 is provided at the rear end of the toilet bowl body 2. The mounting portion 8 mounts the flush toilet 1 on the wall surface via a mounting member. The mounting member is bolts and nuts, for example. The mounting portion 8 is provided with at least two mounting holes 10. Specifically, the mounting portion 8 is provided with at least four mounting holes 10. Three mounting holes 10 may be provided, or more than five may be provided. In the mounting hole 10, a bolt is inserted, for example.

The mounting portion 8 is provided with four mounting holes 10, for example. The four mounting holes 10 include two first mounting holes 10*a* and two second mounting holes 10*b*. The four mounting holes 10 may include three first mounting holes 10*a* and one second mounting hole 10*b*.

The first mounting hole 10*a* is provided above the first virtual centerline L1. The first mounting holes 10*a* are provided at each of both ends in the left-and-right direction. The first mounting holes 10*a* are provided interposing the second virtual centerline L2 of the mounting portion 8 in the left-and-right direction. The second virtual centerline L2 may be the centerline of the drain trap 5 in the left-and-right direction. The second virtual centerline L2 may be the centerline of the toilet bowl body 2 in the left-and-right direction.

The second mounting hole 10*b* is provided below the first mounting hole 10*a*. The second mounting hole 10*b* is provided below the first virtual centerline L1. The second mounting holes 10*b* are provided at each of both ends in the left-and-right direction. The second mounting holes 10*b* are provided interposing the second virtual centerline L2.

The mounting portion 8 includes a first wall thickness area A1 having a wall thickness around the first mounting hole 10*a* and a second wall thickness area A2 having a wall thickness around the second mounting hole 10*b*. The wall thickness is the thickness of the mounting portion 8 in the front-and-back direction (Y-axis direction). The wall thickness of the second wall thickness area A2 is thinner than the wall thickness of the first wall thickness area A1. That is, the wall thickness around the second mounting hole 10*b* is thinner than the wall thickness around the first mounting hole 10*a*.

The first wall thickness area A1 is provided on the upper side in the mounting portion 8. The first wall thickness area A1 includes the surrounding of the first mounting hole 10*a*. The first wall thickness area A1 is provided to extend in the left-and-right direction.

The second wall thickness area A2 is provided below the first wall thickness area A1. The second wall thickness area A2 includes the surrounding of the second mounting hole 10*b*. The second wall thickness area A2 is provided to extend in the left-and-right direction. When the mounting portion 8 is viewed from the bowl portion 3 side (front side), the second wall thickness area A2 is wider than the first wall thickness area A1.

The second wall thickness area A2 is provided down to the lower side of the drain trap 5. That is, the mounting portion 8 is provided so that the lower end of the mounting portion 8 is below the lower end of the drain trap 5. The lower end of the mounting portion 8 is provided below the lower end of the ascending pipe 5*a* of the drain trap 5 and the lower end of the descending pipe 5*b* of the drain trap 5.

The modesty panel 9 connects the drain trap 5 and the mounting portion 8. The modesty panel 9 is connected to the mounting portion 8 in the second wall thickness area A2 below the descending pipe 5*b*. The modesty panel 9 is provided to include the second virtual centerline L2. The modesty panel 9 is provided so as to extend from the mounting portion 8 to the lower end of the ascending pipe 5*a* of the drain trap 5. The modesty panel 9 is connected to the drain trap 5 along the lower end of the drain trap 5. A part of the modesty panel 9 may be not connected to the lower end of the drain trap 5.

A plurality of modesty panels 9 may be provided. The modesty panel 9 may be provided so as not to include the second virtual centerline L2. For example, a plurality of modesty panels 9 may be provided interposing the second virtual centerline L2.

In the wall-hung type flush toilet 1, due to moments, a load applied around the mounting member inserted into the first mounting hole 10*a* is large. The flush toilet 1 is provided with the first wall thickness area A1 with a thick wall thickness around the first mounting hole 10*a*, thereby ensuring the strength of the flush toilet 1. In the flush toilet 1, the flush toilet 1 is reliably secured to the wall surface by the mounting member inserted into the second mounting hole 10*b*.

The flush toilet 1 is mounted on the wall surface. The flush toilet 1 has the bowl portion 3 and the mounting portion 8. The bowl portion 3 receives the waste. The mounting portion 8 is provided between the bowl portion 3 and the wall surface and mounts the flush toilet 1 on the wall surface via the mounting member. The mounting portion 8 has at least two mounting holes 10. The wall thickness around the second mounting hole 10*b* on the lower side is thinner than the wall thickness around the first mounting hole 10*a* on the upper side.

This enables the flush toilet 1 to ensure the strength of the flush toilet 1 against the load due to the moments, by the thick wall portion around the first mounting hole 10*a*. Therefore, the flush toilet 1 can ensure load-bearing performance. In the flush toilet 1, the flush toilet 1 can be made light in weight by making the wall thickness around the second mounting hole 10*b* thinner than the wall thickness around the first mounting hole 10*a*. That is, the flush toilet 1 can be made light in weight while maintaining the load-bearing performance.

Furthermore, the light weight of the flush toilet 1 can facilitate the installation when mounting the flush toilet 1 on the wall surface. The light weight of the flush toilet 1 can reduce the moment generated in the flush toilet 1 when mounted on the wall surface.

The mounting portion 8 has at least four mounting holes 10. The second mounting hole 10*b* among the mounting holes 10 is provided below the first virtual centerline L1 of the mounting portion 8 in the up-and-down direction.

This enables the flush toilet 1 to be stably mounted on the wall surface by the mounting member inserted into the second mounting hole 10*b*.

The flush toilet 1 includes the drain trap 5, the drain socket 6, and the drain flange portion 7. The drain trap 5 communicates with the bowl portion 3 so as to discharge the waste from the bowl portion. The drain socket 6 connects the drain trap 5 to the discharge pipe provided on the wall surface. The drain flange portion 7 is provided around the drain socket 6. The drain flange portion 7 is provided below the first virtual centerline L1.

This enables the flush toilet 1 to reduce the moment applied to the drain flange portion 7.

The mounting portion 8 includes the first wall thickness area A1 and the second wall thickness area A2. The first wall thickness area A1 has a wall thickness around the first mounting hole 10*a*. The second wall thickness area A2 has a wall thickness around the second mounting hole 10*b*. When the mounting portion 8 is viewed from the bowl portion 3 side, the second wall thickness area A2 is wider than the first wall thickness area A1.

This enables the flush toilet 1 to be lighter in weight. The flush toilet 1 can further facilitate the installation when mounting the flush toilet 1 on the wall surface. In addition, the flush toilet 1 can further reduce the moment generated in the flush toilet 1 when mounted on the wall surface.

The flush toilet 1 is equipped with the modesty panel 9. The modesty panel 9 connects the drain trap 5 and the mounting portion 8. The drain trap 5 includes the ascending pipe 5*a* and the descending pipe 5*b*. The ascending pipe 5*a* extends obliquely upward from the lower end of the bowl portion 3 toward the wall surface side. The descending pipe 5*b* connects the ascending pipe 5*a* and the drain socket 6 and extends obliquely downward from the upper end of the ascending pipe 5*a* toward the drain socket 6. The modesty panel 9 is connected to the mounting portion 8 below the descending pipe 5*b*.

This enables the flush toilet 1 to enhance the strength against moments by the modesty panel 9. As a result, the flush toilet 1 can improve the load-bearing performance. Furthermore, the flush toilet 1 can enhance the strength of the second wall thickness area A2 by connecting the modesty panel 9 to the second wall thickness area A2.

An object of one aspect of the embodiment is to provide a flush toilet capable of responding to fluctuations in the flow rate of washing water and ensuring the basic performance of the toilet bowl in a wide range of water supply flow rates.

The flush toilet according to one aspect of the embodiment includes a bowl portion configured to receive waste, a trap portion extending from the bowl portion and configured to discharge the waste received in the bowl portion, a main conduit through which washing water toward the bowl portion flows, a rim communication hole into which washing water flows from the main conduit, a rim conduit through which washing water that has flowed in from the rim communication hole flows, and a rim spout configured to supply washing water flowing through the rim conduit to the bowl portion, in which the rim spout has a low-flow rate spout that becomes the rim spout when the washing water flowing through the rim conduit is of a low flow rate and a high-flow rate spout that becomes the rim spout when the washing water flowing through the rim conduit is of a high flow rate.

According to such a configuration, when the washing water flowing through the rim conduit is of a low flow rate, the low-flow rate spout is, as the rim spout, switched to. This makes it possible to suppress the lowering in the flow force (flow velocity) of the washing water supplied from the rim spout (low-flow rate spout) when the washing water flowing through the rim conduit is of a low flow rate, thereby suppressing the deterioration in the washing performance of the bowl portion. Meanwhile, when the washing water flowing through the rim conduit is of a high flow rate, the high-flow rate spout is, as the rim spout, switched to. This makes it possible to suppress the flow force (flow velocity) of the washing water supplied from the rim spout (high-flow rate spout) from increasing excessively when the washing water flowing through the rim conduit is of a high flow rate, thereby preventing the washing water from jumping out from the bowl portion. Thus, because it is possible to suppress the deterioration in the washing performance and prevent the washing water from jumping out regardless of fluctuations in the flow rate of the washing water, that is, it is possible to respond to the fluctuations in the flow rate of the washing water, the basic performance of the toilet bowl can be ensured over a wide range of water supply flow rates.

In the above-described flush toilet, the low-flow rate spout and the high-flow rate spout are formed in the same flow path, and the low-flow rate spout has a flow-path cross-sectional area smaller than a flow-path cross-sectional area of the high-flow rate spout.

According to such a configuration, when the washing water flowing through the rim conduit is of a low flow rate, the flow velocity of the washing water supplied to the bowl portion is regulated by the low-flow rate spout having a small flow-path cross-sectional area. This makes it possible to suppress the lowering in the flow velocity of the washing water supplied from the rim spout (low-flow rate spout) when the washing water W flowing through the rim conduit is of a low flow rate, thereby suppressing the deterioration in the washing performance of the bowl portion. Meanwhile, when the washing water flowing through the rim conduit is of a high flow rate, the flow velocity of the washing water supplied to the bowl portion is regulated by the high-flow rate spout having a large flow-path cross-sectional area. This makes it possible to suppress the flow velocity of the washing water supplied from the rim spout (high-flow rate spout) from increasing excessively when the washing water flowing through the rim conduit is of a high flow rate, thereby preventing the washing water from jumping out from the bowl portion.

In the above-described flush toilet, the low-flow rate spout is arranged on the upstream side of the high-flow rate spout.

According to such a configuration, it makes it possible to form the low-flow rate spout and the high-flow rate spout in the same flow path. When the washing water W flowing through the rim conduit is of a low flow rate, the washing water is supplied to the bowl portion from the low-flow rate spout, and the lowering in the flow velocity of the washing water supplied from the rim spout (low-flow rate spout) can be suppressed, thereby suppressing the deterioration in the washing performance of the bowl portion. Meanwhile, when the washing water flowing through the rim conduit is of a high flow rate, the flow velocity of the washing water supplied from the rim spout (high-flow rate spout) can be suppressed from increasing excessively, thereby preventing the washing water from jumping out from the bowl portion.

In the above-described flush toilet, between the low-flow rate spout and the high-flow rate spout including at least a downstream region immediately adjacent to the low-flow rate spout, the rim conduit has a flow-path cross-sectional area that expands continuously and gradually from the low-flow rate spout side toward the high-flow rate spout side.

According to such a configuration, as the flow path of the rim conduit, between the low-flow rate spout and the high-flow rate spout including at least a downstream region immediately adjacent to the low-flow rate spout, is gently expanded from the upstream low-flow rate spout side toward the downstream high-flow rate spout side, the washing water flowing through the rim conduit from the low-flow-rate spout side to the high-flow-rate spout side is attracted to the inner surface of the rim conduit (Coanda effect) and the washing water flows along the shape of the rim conduit, so that the water can be prevented from running out. This makes it possible to suppress the lowering in the flow velocity of the washing water supplied from the rim spout (low-flow rate spout) when the washing water flowing through the rim conduit is of a low flow rate, thereby suppressing the deterioration in the washing performance of the bowl portion.

In the above-described flush toilet, the rim conduit has an agitation chamber having a flow-path cross-sectional area larger than the flow-path cross-sectional area of the low-flow rate spout on the upstream side of the low-flow rate spout.

According to such a configuration, the flow of washing water is disrupted in the agitation chamber and the washing water of the disrupted flow flows into the low-flow rate spout, thereby making the low-flow rate spout easier to be watertight. This makes it possible to suppress the lowering in the flow velocity of the washing water supplied from the rim spout (low-flow rate spout) when the washing water flowing through the rim conduit is of a low flow rate, thereby suppressing the deterioration in the washing performance of the bowl portion.

In the above-described flush toilet, further provided are a jet conduit through which the washing water from the main conduit flows, a jet spout configured to jet the washing water that has flowed through the jet conduit from the front of the trap portion toward the trap portion, and a pressure-rate control portion connecting the main conduit and the rim conduit on the upstream side of the jet conduit.

According to such a configuration, the rim conduit branches off from the main conduit on the upstream side of the jet conduit, so that the flow velocity of the washing water flowing into the rim conduit does not affect the jet spout having a high flow velocity, and the flow velocity of the washing water flowing into the rim conduit from the main conduit can be regulated by the pressure-rate control portion. As a result, when the washing water flowing through the rim conduit is of a low flow rate, the washing water is supplied to the bowl portion from the low-flow rate spout, and the lowering in the flow velocity of the washing water supplied from the rim spout (low-flow rate spout) can be suppressed, thereby suppressing the deterioration in the washing performance of the bowl portion. Meanwhile, when the washing water flowing through the rim conduit is of a high flow rate, the flow velocity of the washing water supplied from the rim spout (high-flow rate spout) can be suppressed from increasing excessively, thereby preventing the washing water from jumping out from the bowl portion.

In the above-described flush toilet, the rim conduit has an agitation chamber on the upstream side of the low-flow rate spout, the low-flow rate spout has the flow-path cross-sectional area larger than a flow-path cross-sectional area of the pressure-rate control portion, and the high-flow rate spout and the agitation chamber have a flow-path cross-sectional area larger than the flow-path cross-sectional area of the low-flow rate spout.

According to such a configuration, the washing water distribution of the rim spout and the jet spout can be determined by the pressure-rate control portion, and when the washing water flowing through the rim conduit is of a low flow rate, the washing water can be regulated by the small flow-path cross-sectional area of the low-flow rate spout.

In the above-described flush toilet, the pressure-rate control portion has a central axis in the flow direction of the washing water located above a central axis in the flow direction of the washing water in the low-flow rate spout.

According to such a configuration, the washing water that has gained momentum (accelerated) in the pressure-rate control portion does not flow directly into the low-flow rate spout but flows into the low-flow rate spout after the flow is in a turbulent and swirling state in the agitation chamber, thereby making the low-flow rate spout easier to be watertight. This makes it possible to suppress the lowering in the flow velocity of the washing water supplied from the rim spout (low-flow rate spout) when the washing water flowing through the rim conduit is of a low flow rate, thereby suppressing the deterioration in the washing performance of the bowl portion.

In the above-described flush toilet, the rim conduit has an agitation chamber having a flow-path cross-sectional area larger than the flow-path cross-sectional area of the low-flow rate spout on the upstream side of the low-flow rate spout, and the agitation chamber has a wall portion on the upstream side of the low-flow rate spout.

According to such a configuration, the washing water that has gained momentum (accelerated) in the pressure-rate control portion flows into the low-flow rate spout after colliding with the wall portion, thereby causing the flow to be in a turbulent and swirling state in the agitation chamber and making the low-flow rate spout easier to be watertight. This makes it possible to suppress the lowering in the flow velocity of the washing water supplied from the rim spout (low-flow rate spout) when the washing water flowing through the rim conduit is of a low flow rate, thereby suppressing the deterioration in the washing performance of the bowl portion.

According to the flush toilet in one aspect of the embodiment, it is possible to respond to fluctuations in the flow rate of the washing water and ensure the basic performance of the toilet bowl over a wide range of water-supply flow rates.

An object of one aspect of the embodiment is to provide a flush toilet capable of suppressing the generation of abnormal noise.

A flush toilet according to one aspect of the embodiment is equipped with a bowl portion, a trap portion, and a jet spout portion. The bowl portion receives waste. The trap portion communicates with the bowl portion so as to discharge the waste from the bowl portion. The jet spout portion jets the washing water from the front of the trap portion toward the trap portion. The jet spout portion includes a jet conduit and a jet spout. The jet conduit is formed so as to flow the washing water therethrough. The jet spout is formed at the distal end of the jet conduit and jets the washing water toward the trap portion. The jet conduit includes a contracted portion. The contracted portion has a cross-sectional area that becomes smaller toward the jet spout side. The cross-sectional area of the jet spout is the smallest of all the cross-sectional areas of the jet conduit. The reduction ratio in the width of the top surface of the contracted portion in the flow direction of the washing water in the jet conduit is smaller than the reduction ratio in the width of the bottom surface of the contracted portion in the flow direction. The angle formed between at least one side surface, among the side surfaces of the jet conduit, and the top surface of the jet conduit is an acute angle.

This enables the flush toilet to subdivide the air in the jet conduit by causing changes in the flow velocity of the washing water in the contracted area. Furthermore, by increasing the change in the flow velocity of the washing water on the top surface side of the contracted portion, the flush toilet can subdivide the air suspended on the top surface side of the contracted portion. By making the angle that is formed between the side surface of the jet conduit and the top surface of the jet conduit be an acute angle, the flush toilet can subdivide the air accumulated between the top surface and the side surface by the washing water having a slow flow velocity near the top surface. As a result, the flush toilet can suppress pressure changes in the jet conduit and reduce the generation of abnormal noise.

Furthermore, the jet conduit includes a curved portion. The curved portion is connected to the contracted portion and changes the flow direction of the washing water in a direction from flowing from backward to forward, to a direction from forward to backward.

This enables the flush toilet to subdivide the air by the contracted portion provided on the downstream side of the curved portion in the flow direction of the washing water flowing through the jet conduit. Therefore, the flush toilet can jet the washing water, including subdivided air, from the jet spout. Consequently, the flush toilet can suppress the generation of abnormal noise caused by the washing water jetted from the jet spout.

The angle that is formed between at least one side surface, among the side surfaces of the contracted portion, and the top surface of the contracted portion is an acute angle.

This enables the flush toilet to subdivide the air accumulated between the top surface of the contraction and the side surfaces of the contracted portion, by the washing water having a slow flow velocity near the top surface of the contracted portion. As a result, the flush toilet can suppress pressure changes in the contracted portion and reduce the generation of abnormal noise.

The distance between the top surface of the contracted portion and the bottom surface of the contracted portion gradually shortens toward the jet spout side.

As a result, the flush toilet can jet the washing water having little bias in the up-and-down direction from the jet spout while suppressing the generation of abnormal noise in the jet conduit. Therefore, the flush toilet can prevent the discharge performance of waste by the washing water jetted from the jet spout from being deteriorated while suppressing the generation of abnormal noise.

The distance between the side surfaces of the contracted portion gradually shortens toward the jet spout side.

As a result, the flush toilet can jet the washing water having little bias in the left-and-right direction from the jet spout while suppressing the generation of abnormal noise in the jet conduit. Therefore, the flush toilet can prevent the discharge performance of waste by the washing water jetted from the jet spout from being deteriorated while suppressing the generation of abnormal noise.

According to one aspect of the embodiment, the generation of abnormal noise can be suppressed.

An object of one aspect of the embodiment is to provide a flush toilet that is light in weight while maintaining the load-bearing performance.

A flush toilet in one aspect of the embodiment is mounted on a wall surface. The flush toilet has a bowl portion and a mounting portion. The bowl portion receives waste. The mounting portion is provided between the bowl portion and the wall surface and mounts the flush toilet on the wall surface via a mounting member. The mounting portion has at least two mounting holes. The wall thickness around the mounting hole on the lower side is thinner than the wall thickness around the mounting hole on the upper side.

This enables the flush toilet to ensure the strength of the flush toilet against loads due to the moments, by the thick wall portion around the mounting hole on the upper side. Thus, the flush toilet can ensure the load-bearing performance. The flush toilet can be made light in weight by making the wall thickness around the mounting hole on the lower side thinner than the wall thickness around the mounting hole on the upper side. That is, the flush toilet can be made light in weight while maintaining the load-bearing performance. Furthermore, the light weight of the flush toilet can facilitate the installation of the flush toilet on the wall surface. In addition, by being light in weight, the flush toilet can reduce the moment generated in the flush toilet, when mounted on the wall surface.

The mounting portion has at least four mounting holes. At least one mounting hole is provided below the virtual centerline of the mounting portion in the up-and-down direction.

This enables the flush toilet to be stably mounted on the wall surface by the mounting member inserted into the mounting hole below the virtual centerline of the mounting section.

The flush toilet includes a trap portion, a drain socket, and a drain flange portion. The trap portion communicates with the bowl portion so as to discharge the waste from the bowl portion. The drain socket connects the trap portion to a discharge pipe provided on the wall surface. The drain flange portion is provided around the drain socket. The drain flange portion is provided below the virtual centerline.

This enables the flush toilet to reduce the moment applied to the drain flange portion.

The mounting portion includes a first wall thickness area and a second wall thickness area. The first wall thickness area has a wall thickness around the mounting holes on the upper side. The second wall thickness area has a wall thickness around the mounting holes on the lower side. When the mounting portion is viewed from the bowl portion side, the second wall thickness area is wider than the first wall thickness area.

This enables the flush toilet to be lighter in weight. The flush toilet can further facilitate the installation of the flush toilet on the wall surface. In addition, the flush toilet can further reduce the moment generated in the flush toilet when mounted on the wall surface.

The flush toilet is also equipped with a modesty panel. The modesty panel connects the trap portion and the mounting portion. The trap portion includes an ascending pipe and a descending pipe. The ascending pipe extends obliquely upward from the lower end of the bowl portion toward the wall surface side. The descending pipe connects the ascending pipe and the drain socket and extends obliquely downward from the upper end of the ascending pipe toward the drain socket. The modesty panel is connected to the mounting portion below the descending pipe.

This enables the flush toilet to enhance the strength against moments by the modesty panel. As a result, the flush toilet can improve the load-bearing performance. Furthermore, the flush toilet can enhance the strength of the second wall thickness area by connecting the modesty panel to the second wall thickness area.

According to one aspect of the embodiment, weight saving can be achieved while maintaining the load-bearing performance.

Appendix 1-1

A flush toilet including:

a bowl portion configured to receive waste; a trap portion extending from the bowl portion and configured to discharge the waste received in the bowl portion;

a main conduit through which washing water toward the bowl portion flows;

a rim communication hole into which the washing water flows from the main conduit;

a rim conduit through which the washing water that has flowed in from the rim communication hole flows; and a rim spout configured to supply the washing water flowing through the rim conduit to the bowl portion, wherein the rim spout has a low-flow rate spout that becomes the rim spout when the washing water flowing through the rim conduit is of a low flow rate and a high-flow rate spout that becomes the rim spout when the washing water flowing through the rim conduit is of a high flow rate.

Appendix 1-2

The flush toilet according to Appendix 1-1, wherein the low-flow rate spout and the high-flow rate spout are formed in the same flow path, and the low-flow rate spout has a flow-path cross-sectional area smaller than a flow-path cross-sectional area of the high-flow rate spout.

Appendix 1-3

The flush toilet according to Appendix 1-2, wherein the low-flow rate spout is arranged on an upstream side of the high-flow rate spout.

Appendix 1-4

The flush toilet according to Appendix 1-3, wherein the rim conduit has, between the low-flow rate spout and the high-flow rate spout including at least a downstream region immediately adjacent to the low-flow rate spout, a flow-path cross-sectional area that expands continuously and gradually from the low-flow rate spout side toward the high-flow rate spout side.

Appendix 1-5

The flush toilet according to Appendix 1-2, wherein the rim conduit has an agitation chamber having a flow-path cross-sectional area larger than the flow-path cross-sectional area of the low-flow rate spout on an upstream side of the low-flow rate spout.

Appendix 1-6

The flush toilet according to Appendix 1-2, further including:

a jet conduit through which the washing water from the main conduit flows, a jet spout configured to jet the washing water that has flowed through the jet conduit from the front of the trap portion toward the trap portion, and a pressure-rate control portion connecting the main conduit and the rim conduit on an upstream side of the jet conduit.

Appendix 1-7

The flush toilet according to Appendix 1-6, wherein the rim conduit has an agitation chamber on an upstream side of the low-flow rate spout, the low-flow rate spout has the flow-path cross-sectional area larger than a flow-path cross-sectional area of the pressure-rate control portion, and the high-flow rate spout and the agitation chamber have a flow-path cross-sectional area larger than the flow-path cross-sectional area of the low-flow rate spout.

Appendix 1-8

The flush toilet according to Appendix 1-6, wherein the pressure-rate control portion has a central axis in a flow direction of the washing water located above a central axis in the flow direction of the washing water in the low-flow rate spout.

Appendix 1-9

The flush toilet according to Appendix 1-8, wherein the rim conduit has an agitation chamber having a flow-path cross-sectional area larger than the flow-path cross-sectional area of the low-flow rate spout on an upstream side of the low-flow rate spout, and the agitation chamber has a wall portion on the upstream side of the low-flow rate spout.

Appendix 2-1

A flush toilet including:

a bowl portion configured to receive waste;

a trap portion communicating with the bowl portion so as to discharge the waste in the bowl portion; and a jet spout portion configured to jet washing water from a front of the trap portion toward the trap portion; wherein the jet spout portion has a jet conduit formed so that the washing water flows therethrough, and a jet spout formed at a distal end of the jet conduit and configured to jet the washing water toward the trap portion, the jet conduit has a contracted portion for which a cross-sectional area becomes smaller toward the jet spout side, the cross-sectional area of the jet spout is the smallest of all cross-sectional areas of the jet conduit, a reduction ratio in a width of a top surface of the contracted portion in a flow direction of the washing water in the jet conduit is smaller than a reduction ratio in the width of a bottom surface of the contracted portion in the flow direction, and an angle formed between at least one side surface, among side surfaces of the jet conduit, and a top surface of the jet conduit is an acute angle.

Appendix 2-2

The flush toilet according to Appendix 2-1, wherein the jet conduit has a curved portion connected to the contracted portion and configured to change the flow direction of the washing water in a direction from backward to forward, to a direction from forward to backward.

Appendix 2-3

The flush toilet according to Appendix 2-1, wherein an angle formed between at least one side surface, among side surfaces of the contracted portion, and a top surface of the contracted portion is an acute angle.

Appendix 2-4

The flush toilet according to any one of Appendices 2-1 to 2-3, wherein a distance between the top surface of the contracted portion and the bottom surface of the contracted portion gradually shortens toward the jet spout side.

Appendix 2-5

The flush toilet according to any one of Appendices 2-1 to 2-3, wherein a distance between side surfaces of the contracted portion gradually shortens toward the jet spout side.

Appendix 3-1

A flush toilet to be mounted on a wall surface, including:

a bowl portion configured to receive waste; and a mounting portion provided between the bowl portion and the wall surface and configured to mount the flush toilet on the wall surface via a mounting member, wherein the mounting portion has at least two mounting holes, and a wall thickness around the mounting hole on a lower side is thinner than a wall thickness around the mounting hole on an upper side.

Appendix 3-2

The flush toilet according to Appendix 3-1, wherein the mounting portion has at least four mounting holes, and at least one mounting hole is provided on a lower side than a virtual centerline of the mounting portion in an up-and-down direction.

Appendix 3-3

The flush toilet according to Appendix 3-2, further including:

a trap portion communicating with the bowl portion so as to discharge the waste in the bowl portion;

a drain socket configured to connect the trap portion to a discharge pipe provided on the wall surface; and a drain flange portion provided around the drain socket, wherein the drain flange portion is provided below the virtual centerline.

Appendix 3-4

The flush toilet according to any one of Appendices 3-1 to 3-3, wherein the mounting portion includes a first wall thickness area having a wall thickness around the mounting hole on the upper side and a second wall thickness area having a wall thickness around the mounting hole on the lower side, and the second wall thickness area is wider than the first wall thickness area when the mounting portion is viewed from the bowl portion side.

Appendix 3-5

The flush toilet according to Appendix 3-3, further including:

a modesty panel connecting the trap portion and the mounting portion, wherein the trap portion includes an ascending pipe extending obliquely upward from a lower end of the bowl portion toward the wall surface side and a descending pipe connecting the ascending pipe and the drain socket and extending obliquely downward from an upper end of the ascending pipe toward the drain socket, and the modesty panel is connected to the mounting portion below the descending pipe.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet comprising:

a bowl portion configured to receive waste;

a trap portion extending from the bowl portion and configured to discharge the waste received by the bowl portion;

a main conduit through which washing water toward the bowl portion flows;

a rim communication hole into which the washing water flows from the main conduit;

a rim conduit through which the washing water that has flowed in from the rim communication hole flows;

a rim spout configured to supply the washing water flowing through the rim conduit to the bowl portion; and a smaller flow-path portion formed on an upstream side of the rim spout in the rim conduit and having a flow-path cross-sectional area smaller than a flow-path cross-sectional area of the rim spout, wherein the smaller flow-path portion and the rim spout are formed in a same flow path, a first inclined wall is formed for which an upper surface is inclined upward toward downstream up to the rim spout including a downstream region of the smaller flow-path portion, and a second inclined wall is formed for which a bottom surface is inclined downward toward downstream up to the rim spout including a downstream region of the smaller flow-path portion, wherein the first inclined wall and the second inclined wall are formed on an upper side and a lower side, respectively, in a vertical direction, and a central axis of the smaller flow-path portion in a flow direction of the washing water is located below a central axis of the rim spout in a flow direction of the washing water.

2. The flush toilet according to claim 1, wherein the rim conduit has, between the smaller flow-path portion and the rim spout including at least a downstream region immediately adjacent to the smaller flow-path portion, a flow-path cross-sectional area that expands continuously and gradually from the smaller flow-path portion side toward the rim spout side.

3. The flush toilet according to claim 1, wherein the rim conduit includes an agitation chamber having a flow-path cross-sectional area larger than the flow-path cross-sectional area of the smaller flow-path portion on an upstream side of the smaller flow-path portion.

4. The flush toilet according to claim 1, further comprising:

a jet conduit through which the washing water from the main conduit flows, a jet spout configured to jet the washing water that has flowed through the jet conduit from the front of the trap portion toward the trap portion, and a pressure-rate control portion connecting the main conduit and the rim conduit on an upstream side of the jet conduit.

5. The flush toilet according to claim 4, wherein the rim conduit includes an agitation chamber on an upstream side of the smaller flow-path portion, the smaller flow-path portion has the flow-path cross-sectional area larger than a flow-path cross-sectional area of the pressure-rate control portion, and the rim spout and the agitation chamber have a flow-path cross-sectional area larger than the flow-path cross-sectional area of the smaller flow-path portion.

6. The flush toilet according to claim 4, wherein the pressure-rate control portion has a central axis in a flow direction of the washing water located above a central axis of the smaller flow-path portion in the flow direction of the washing water.

7. The flush toilet according to claim 6, wherein the rim conduit includes an agitation chamber having a flow-path cross-sectional area larger than the flow-path cross-sectional area of the smaller flow-path portion on an upstream side of the smaller flow-path portion, and the agitation chamber includes a wall portion on the upstream side of the smaller flow-path portion.

8. A flush toilet comprising:

a bowl portion configured to receive waste;

a trap portion extending from the bowl portion and configured to discharge the waste received by the bowl portion;

a main conduit through which washing water toward the bowl portion flows;

a rim communication hole into which the washing water flows from the main conduit;

a rim conduit through which the washing water that has flowed in from the rim communication hole flows;

a rim spout configured to supply the washing water flowing through the rim conduit to the bowl portion; and a smaller flow-path portion formed on an upstream side of the rim spout in the rim conduit and having a flow-path cross-sectional area smaller than a flow-path cross-sectional area of the rim spout, wherein the smaller flow-path portion and the rim spout are formed in a same flow path, a first inclined wall is formed for which an upper surface is inclined upward toward downstream up to the rim spout including a downstream region of the smaller flow-path portion, and a second inclined wall is formed for which a bottom surface is inclined downward toward downstream up to the rim spout including a downstream region of the smaller flow-path portion, wherein the first inclined wall and the second inclined wall are formed on an upper side and a lower side, respectively, in a vertical direction, the flush toilet further comprising:

a jet conduit through which the washing water from the main conduit flows, a jet spout configured to jet the washing water that has flowed through the jet conduit from the front of the trap portion toward the trap portion, and a pressure-rate control portion connecting the main conduit and the rim conduit on an upstream side of the jet conduit, wherein the jet spout is formed at a distal end of the jet conduit, the jet conduit includes a contracted portion having a cross-sectional area that becomes smaller toward the jet spout side, the cross-sectional area of the jet spout is the smallest of all cross-sectional areas of the jet conduit, a reduction ratio in a width of a top surface of the contracted portion in a flow direction of the washing water in the jet conduit is smaller than a reduction ratio in the width of a bottom surface of the contracted portion in the flow direction, and an angle formed between at least one side surface, among side surfaces of the jet conduit, and a top surface of the jet conduit is an acute angle.

9. The flush toilet according to claim 8, wherein the jet conduit includes a curved portion connected to the contracted portion and configured to change the flow direction of the washing water in a direction from backward to forward, to a direction from forward to backward.

10. The flush toilet according to claim 8, wherein an angle formed between at least one side surface, among side surfaces of the contracted portion, and a top surface of the contracted portion is an acute angle.

11. The flush toilet according to claim 8, wherein a distance between the top surface of the contracted portion and the bottom surface of the contracted portion gradually shortens toward the jet spout side.

12. The flush toilet according to claim 8, wherein a distance between side surfaces of the contracted portion gradually shortens toward the jet spout side.

13. The flush toilet according to claim 4, further comprising a mounting portion provided between the bowl portion and a wall surface and configured to mount the flush toilet on the wall surface via a mounting member, wherein the mounting portion has at least two mounting holes, and a wall thickness around the mounting hole on a lower side is thinner than a wall thickness around the mounting hole on an upper side.

14. The flush toilet according to claim 13, wherein the mounting portion has at least four mounting holes, and at least one mounting hole is provided on a lower side than a virtual centerline of the mounting portion in an up-and-down direction.

15. The flush toilet according to claim 14, further comprising:

a drain socket configured to connect the trap portion to a discharge pipe provided on the wall surface; and a drain flange portion provided around the drain socket, wherein the drain flange portion is provided below the virtual centerline.

16. The flush toilet according to claim 13, wherein the mounting portion includes a first wall thickness area having a wall thickness around the mounting hole on the upper side and a second wall thickness area having a wall thickness around the mounting hole on the lower side, and the second wall thickness area is wider than the first wall thickness area when the mounting portion is viewed from the bowl portion side.

17. The flush toilet according to claim 15, further comprising:

a modesty panel connecting the trap portion and the mounting portion, wherein the trap portion includes an ascending pipe extending obliquely upward from a lower end of the bowl portion toward the wall surface side and a descending pipe connecting the ascending pipe and the drain socket and extending obliquely downward from an upper end of the ascending pipe toward the drain socket, and the modesty panel is connected to the mounting portion below the descending pipe.

* * * * *